US012258965B2

(12) United States Patent
Ishiguro et al.

(10) Patent No.: US 12,258,965 B2
(45) Date of Patent: Mar. 25, 2025

(54) COMPRESSOR HAVING BULGED BUSHINGS

(71) Applicants: TAIHO KOGYO Co., Ltd., Toyota (JP); Daikin Industries, Ltd., Osaka (JP)

(72) Inventors: Ukyo Ishiguro, Toyota (JP); Shingo Goto, Toyota (JP); Ryohei Nakamura, Toyota (JP); Yasuyuki Tago, Toyota (JP)

(73) Assignees: TAIHO KOGYO Co., Ltd., Aichi (JP); DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/693,604

(22) PCT Filed: Sep. 14, 2022

(86) PCT No.: PCT/JP2022/034408
§ 371 (c)(1),
(2) Date: Mar. 20, 2024

(87) PCT Pub. No.: WO2023/048048
PCT Pub. Date: Mar. 30, 2023

(65) Prior Publication Data

US 2024/0254989 A1 Aug. 1, 2024

(30) Foreign Application Priority Data

Sep. 21, 2021 (JP) ..... 2021-152753

(51) Int. Cl.
*F01C 21/02* (2006.01)
*F04B 27/08* (2006.01)
(Continued)

(52) U.S. Cl.
CPC ..... *F04C 18/332* (2013.01); *F01C 21/02* (2013.01); *F04B 27/0886* (2013.01); *F04C 29/028* (2013.01); *F04C 2240/56* (2013.01)

(58) Field of Classification Search
CPC ..... F04C 18/32; F04C 18/39; F04C 18/36; F04C 18/356; F04C 18/045; F04C 29/332;
(Continued)

(56) References Cited

U.S. PATENT DOCUMENTS 6,626,084 B1 * 9/2003 Nakayama ..... F04B 27/0886 92/71
2002/0134231 A1 9/2002 Nakayama et al.
2017/0218955 A1 * 8/2017 Nishimura ..... F04C 18/3564

FOREIGN PATENT DOCUMENTS

CN 104583599 A * 4/2015 ..... F04C 18/063
JP 06-336989 A 12/1994
(Continued)

OTHER PUBLICATIONS

English copy of JP2005315112n to Kumakura by PE2E Jul. 2, 24.*
(Continued)

*Primary Examiner* — Deming Wan
(74) *Attorney, Agent, or Firm* — Keating & Bennett, LLP

(57) ABSTRACT

A compression mechanism that can suppress generation of galling and seizure is provided. The compression mechanism includes a bush 60 including a first sliding surface 61 sliding with an inner surface 45*a* of a bush hole 45 and a second sliding surface 63 sliding with a side surface 52*a* of a blade of a piston, and includes at least one of a first bulge 62 formed on one of the first sliding surface 61 and the inner surface 45*a* such that a gap X between the first sliding surface 61 and the inner surface 45*a* gradually decreases toward a direction in which lubricant Y is drawn between the first sliding surface 61 and the inner surface 45*a* along with
(Continued)

rocking of the bush 60, and a second bulge 64 formed on the second sliding surface 63 such that the gap X between the second sliding surface 63 and the side surface 52*a* gradually decreases toward a direction in which the lubricant Y is drawn between the second sliding surface 63 and the side surface 52*a* along with forward and backward movement of the blade.

14 Claims, 13 Drawing Sheets

(51) Int. Cl.

| | |
|---|---|
| ***F04C 18/04*** | (2006.01) |
| ***F04C 18/32*** | (2006.01) |
| ***F04C 18/332*** | (2006.01) |
| ***F04C 18/39*** | (2006.01) |
| ***F04C 29/02*** | (2006.01) |

(58) Field of Classification Search
CPC ..... F04C 29/02; F04C 2/322; F04C 2/321; F04C 2/328; F04C 2/332; F04C 2/336; F01C 21/02; F04B 27/0886
See application file for complete search history.

(56) References Cited

FOREIGN PATENT DOCUMENTS

| | | | | | |
|---|---|---|---|---|---|
| JP | 2001-248547 | A | | 9/2001 | |
| JP | 2005315112 | A | * | 11/2005 | ..... F04C 18/32 |
| JP | 2008-163876 | A | | 7/2008 | |
| JP | 2009-174355 | A | | 8/2009 | |
| JP | 2016-035263 | A | | 3/2016 | |
| JP | 2017-008826 | A | | 1/2017 | |

OTHER PUBLICATIONS

Englsih copy of CN 104583599 to Inada by PE2E Jul. 2, 24.*
Official Communication issued in International Patent Application No. PCT/JP2022/034408, mailed on Dec. 6, 2022.

* cited by examiner

COMPRESSOR HAVING BULGED BUSHINGS

TECHNICAL FIELD

The present invention relates to a technique of a compression mechanism.

BACKGROUND ART

Conventionally, a technique of a compression mechanism is known. For example, Patent Literature 1 discloses such technique.

Patent Literature 1 discloses a compression mechanism that compresses a refrigerant by causing a piston provided in a cylinder chamber to perform turning motion. The piston of the compression mechanism is provided with a blade that partitions the cylinder chamber into a suction chamber (low-pressure chamber) and a compression chamber (high-pressure chamber), and the cylinder chamber is provided with a blade groove through which the blade is inserted so as to freely reciprocate. Bushes (high-pressure-side bush and low-pressure-side bush) are provided between both side surfaces of the blade and the blade groove. The blade groove is provided with a bush hole in which the bush is rockably accommodated. The bush slides with respect to the side surface of the blade and the bush hole with motion of the piston.

Here, to the low-pressure-side bush is applied a load due to a pressure difference between the high-pressure side and the low-pressure side in the cylinder chamber. Due to this, it is conceivable that sliding resistance of the low-pressure-side bush becomes relatively large.

In the invention described in Patent Literature 1, a sliding surface of the low-pressure-side bush is provided with an introduction groove for guiding the refrigerant in the blade groove. Introduction of the refrigerant into the introduction groove causes, in the low-pressure-side bush, a load acting in a direction opposite to the load generated by the sliding resistance. This can reduce the sliding resistance of the low-pressure-side bush.

However, in the bush described in Patent Literature 1, the sliding resistance cannot be reduced in a part not provided with the introduction groove, and galling and seizure may occur in the part. Therefore, a compression mechanism that can suppress generation of galling and seizure is required.

CITATION LIST

Patent Literature

Patent Literature 1: Japanese Patent Application Laid-Open No. 2005-315112

SUMMARY OF INVENTION

Technical Problem

The present invention has been made in view of the above circumstances, and an object of the present invention is to provide a compression mechanism that can suppress generation of galling and seizure.

Solution to Problem

The problem to be solved by the present invention is as described above, and a means for solving this problem will be described below.

That is, a compression mechanism of the present invention includes: a cylinder including a cylinder chamber and a blade groove communicating with the cylinder chamber; a piston including a blade that partitions the cylinder chamber into a high-pressure chamber and a low-pressure chamber and is inserted into the blade groove so as to be movable forward and backward, the piston turnably provided in the cylinder chamber; and a bush rockably accommodated in a bush hole formed in the blade groove and including a first sliding surface that slides with an inner surface of the bush hole and a second sliding surface that slides with a side surface of the blade, in which the compression mechanism includes at least one of a first oil film formation portion formed on one of the first sliding surface and the inner surface such that a gap between the first sliding surface and the inner surface gradually decreases toward a direction in which lubricant is drawn between the first sliding surface and the inner surface along with rocking of the bush, and a second oil film formation portion formed on the second sliding surface such that a gap between the second sliding surface and the side surface gradually decreases toward a direction in which lubricant is drawn between the second sliding surface and the side surface along with forward and backward movement of the blade.

The first oil film formation portion is formed so as to bulge on the inner surface side on the first sliding surface.

The first sliding surface includes a first curved surface portion curved along a sliding direction, and a second curved surface portion adjacent in the sliding direction to the first curved surface, and the first oil film formation portion is formed on the first sliding surface by making a radius of curvature of the second curved surface portion larger than a radius of curvature of the first curved surface.

The first oil film formation portion is formed so as to recess on the inner surface.

Both the first oil film formation portion and the second oil film formation portion are included.

The second oil film formation portion is formed so as to bulge on the side surface side on the second sliding surface.

A pair of the first oil film formation portions are formed so as to be positioned on both end sides in a sliding direction of the first sliding surface.

Advantageous Effects of Invention

The present invention achieves the following effects.

The compression mechanism of the present invention can suppress galling and seizure.

In the compression mechanism of the present invention, the first oil film formation portion formed so as to bulge on the first sliding surface of the bush can promote the formation of an oil film.

The compression mechanism of the present invention can relatively easily form the first oil film formation portion.

The compression mechanism of the present invention can effectively promote the formation of oil films on both the first sliding surface and the second sliding surface of the bush.

In the compression mechanism of the present invention, the second oil film formation portion formed so as to bulge on the second sliding surface of the bush can promote the formation of an oil film.

The compression mechanism of the present invention can promote the formation of an oil film on both end sides in the sliding direction of the first sliding surface.

DESCRIPTION OF EMBODIMENTS

Figure 1:
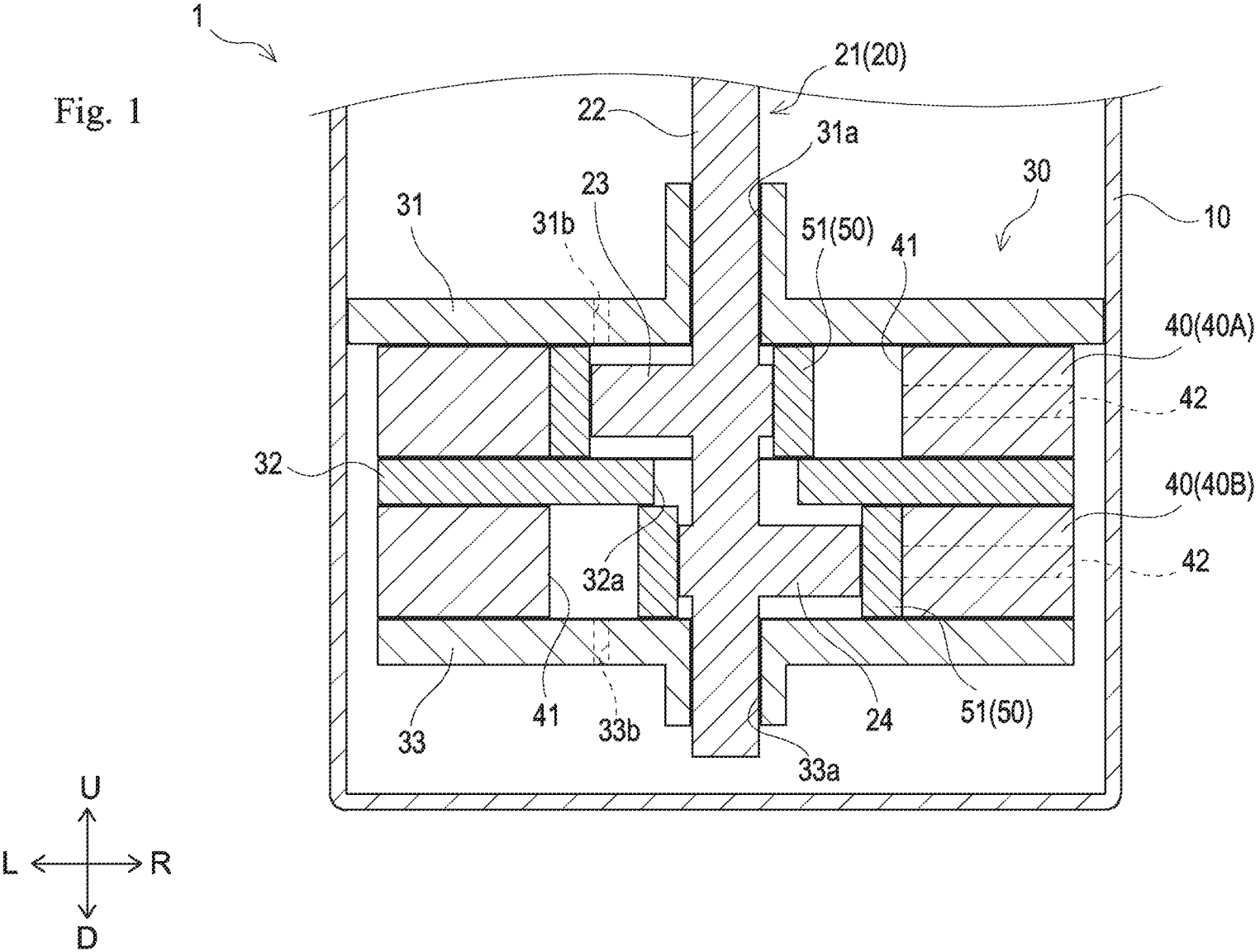
FIG. 1 is a side cross-sectional view illustrating a compressor including a compression mechanism according to a first embodiment of the present invention.

In the following, description will be given with directions indicated by arrows U, D, F, B, L, and R in the drawings defined as an upward direction, a downward direction, a forward direction, a backward direction, a leftward direction, and a rightward direction, respectively. Note that the drawings used in the following description are schematic views, and dimensions and the like of each part are appropriately exaggerated for convenience of description.

First, an outline of a compressor 1 provided with a compression mechanism 30 according to the first embodiment of the present invention will be described with reference to FIGS. 1 and 2.

The compressor 1 compresses a refrigerant. The compressor 1 is used, for example, in a household air conditioner or the like. The compressor 1 compresses and discharges the suctioned refrigerant by driving the compression mechanism 30 by the driving force of a motor 20 provided in a casing 10. Note that the compression mechanism 30 will be described in detail later.

The refrigerant compressed by the compressor 1 circulates in a refrigerant circuit (not illustrated). As the refrigerant, various refrigerants (e.g., refrigerant gas) used in an air conditioner or the like can be adopted. Lubricant Y (see FIG. 8) used for lubrication of the compression mechanism 30 circulates in the refrigerant circuit together with the refrigerant. The compressor 1 includes the casing 10 and the compression mechanism 30.

The casing 10 illustrated in FIG. 1 accommodates the compression mechanism 30. The inside of the casing 10 is a sealed space. The casing 10 is provided with a suction pipe (not illustrated) for sucking the refrigerant into the compression mechanism 30 and a discharge pipe (not illustrated) for discharging the refrigerant discharged from the compression mechanism 30 into the casing 10.

Next, the configuration of the compression mechanism 30 will be described in detail with reference to FIGS. 1 to 7.

By being driven by the driving force of the motor 20, the compression mechanism 30 compresses the suctioned refrigerant. The compression mechanism 30 constitutes a so-called rotary compression mechanism that compresses the refrigerant suctioned into a cylinder chamber 41 of a cylinder 40 by turning motion of a piston 50. As illustrated in FIG. 1, the compression mechanism 30 includes two cylinders 40 vertically parallel to each other and the piston 50. The compression mechanism 30 includes the motor 20, a front head 31, a middle plate 32, a rear head 33, the cylinder 40, the piston 50, and a bush 60.

Figure 2:
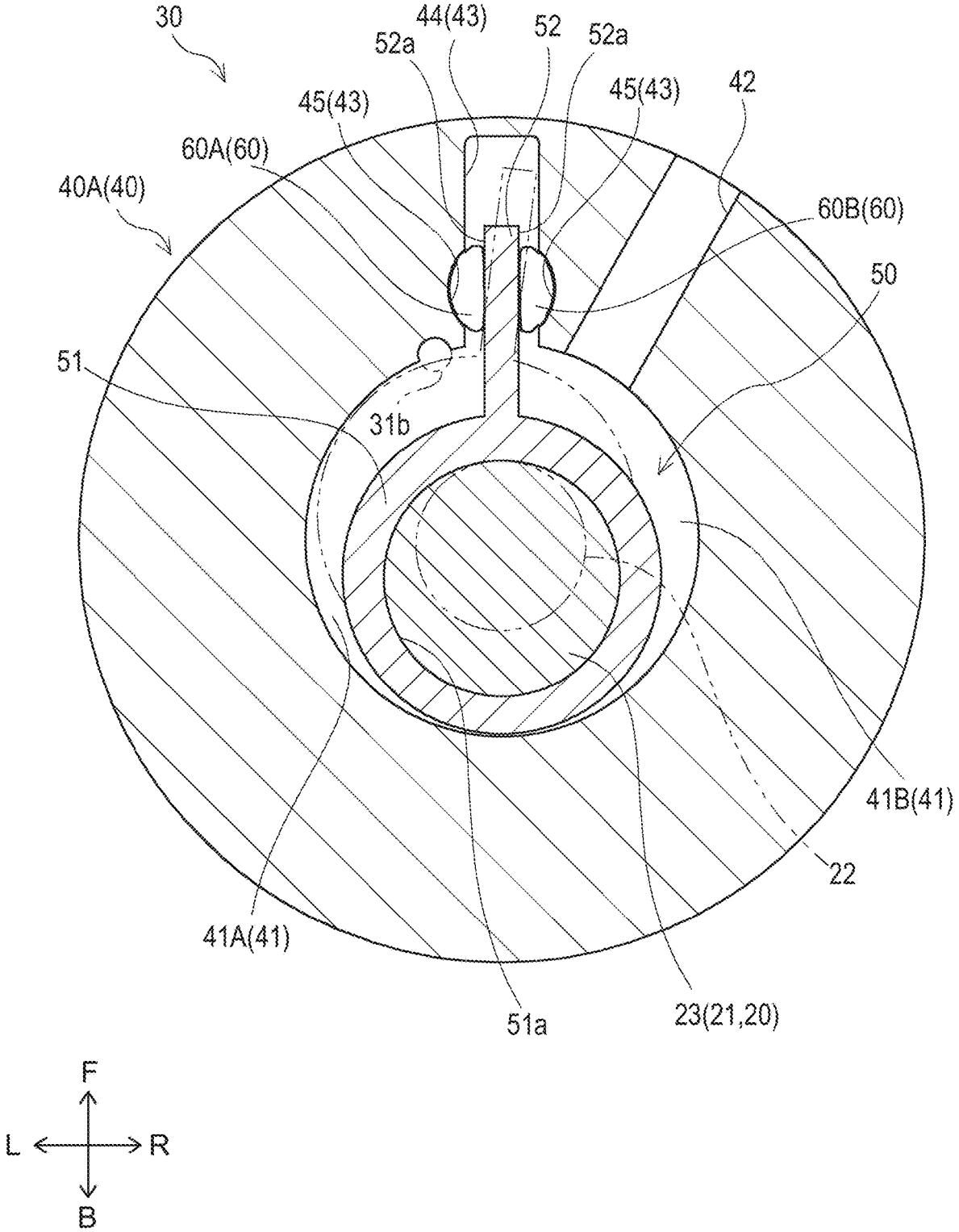
FIG. 2 is a plan cross-sectional view illustrating the compression mechanism.

The motor 20 illustrated in FIGS. 1 and 2 constitutes a drive source of the compression mechanism 30. The motor 20 has a drive shaft 21 that rotates about a central axis whose axial direction is facing the up-down direction. The motor 20 is accommodated in the casing 10 such that the drive shaft 21 protrudes downward. Note that for convenience of description, the rotation phase of the drive shaft 21 is different between FIG. 1 and FIG. 2 and the subsequent drawings. The drive shaft 21 includes a main shaft portion 22, a first eccentric portion 23, and a second eccentric portion 24.

The main shaft portion 22 is a main structural body of the drive shaft 21. The main shaft portion 22 is formed in a substantially columnar shape with the axial direction facing the up-down direction.

The central axis of the first eccentric portion 23 is eccentric with respect to the central axis of the main shaft portion 22 (drive shaft 21). Specifically, the central axis of the first eccentric portion 23 is eccentric in a direction (leftward in FIG. 1) orthogonal to the central axis of the main shaft portion 22. The first eccentric portion 23 is formed in a substantially columnar shape having an enlarged diameter with respect to the main shaft portion 22. The first eccentric portion 23 is formed in an intermediate part in the up-down direction of the main shaft portion 22.

The central axis of the second eccentric portion 24 is eccentric in a direction different from the first eccentric portion 23 with respect to the central axis of the main shaft portion 22 (drive shaft 21). Specifically, the central axis of the second eccentric portion 24 is eccentric in a direction (rightward in FIG. 1) opposite to the first eccentric portion 23. The first eccentric portion 23 is formed in a substantially columnar shape substantially similar to that of the first eccentric portion 23. The second eccentric portion 24 is formed low relative to the first eccentric portion 23 in an intermediate part in the up-down direction of the main shaft portion 22.

The front head 31 illustrated in FIG. 1 constitutes an upper part of the compression mechanism 30. The front head 31 is formed in a substantially plate shape with a plate surface facing the up-down direction. The front head 31 has an opening not illustrated, and partitions the inside of the casing 10 in a state of communicating up and down. The front head 31 includes an insertion hole 31*a* and a discharge port 31*b*.

The insertion hole 31*a* is a part through which the main shaft portion 22 of the drive shaft 21 is inserted. The insertion hole 31*a* is formed so as to penetrate, in the up-down direction, the central part in plan view of the front head 31. The insertion hole 31*a* rotatably supports the main shaft portion 22.

The discharge port 31*b* is a part from which the refrigerant compressed by the cylinder 40 (upper cylinder 40A) is discharged. The discharge port 31*b* is formed so as to penetrate, in the up-down direction, a part radially outside (left side) relative to the insertion hole 31*a* in the front head 31. The discharge port 31*b* communicates between the cylinder chamber 41 described later of the upper cylinder 40A and the inside of the casing 10. The discharge port 31*b* is provided with an appropriate discharge valve (not illustrated) that opens and closes the discharge port 31*b*.

The middle plate 32 separates upper and lower cylinders 40 (upper cylinder 40A and lower cylinder 40B described later). The middle plate 32 is disposed below the front head 31 across the cylinder 40 (upper cylinder 40A). The middle plate 32 includes an insertion hole 32*a*.

The insertion hole 32*a* is a part through which the main shaft portion 22 of the drive shaft 21 is inserted. The insertion hole 32*a* is formed so as to penetrate, in the up-down direction, the central part in plan view of the middle plate 32.

The rear head 33 constitutes a lower part of the compression mechanism 30. The rear head 33 is disposed below the middle plate 32 across the cylinder 40 (lower cylinder 40B). The rear head 33 is formed in a substantially plate shape with a plate surface facing the up-down direction. The rear head 33 includes an insertion hole 33*a* and a discharge port 33*b*.

The insertion hole 33*a* is a part through which the main shaft portion 22 of the drive shaft 21 is inserted. The insertion hole 33*a* is formed so as to penetrate, in the up-down direction, the central part in plan view of the rear head 33. The insertion hole 33*a* rotatably supports the main shaft portion 22.

The discharge port 33*b* is a part from which the refrigerant compressed by the cylinder 40 (lower cylinder 40B) is discharged. The discharge port 33*b* is formed so as to penetrate, in the up-down direction, a part radially outside (left side) relative to the insertion hole 33*a* in the rear head 33. The discharge port 33*b* communicates between the cylinder chamber 41 described later of the lower cylinder 40B and the inside of the casing 10. The discharge port 33*b* is provided with an appropriate discharge valve (not illustrated) that opens and closes the discharge port 33*b*.

Figure 3:
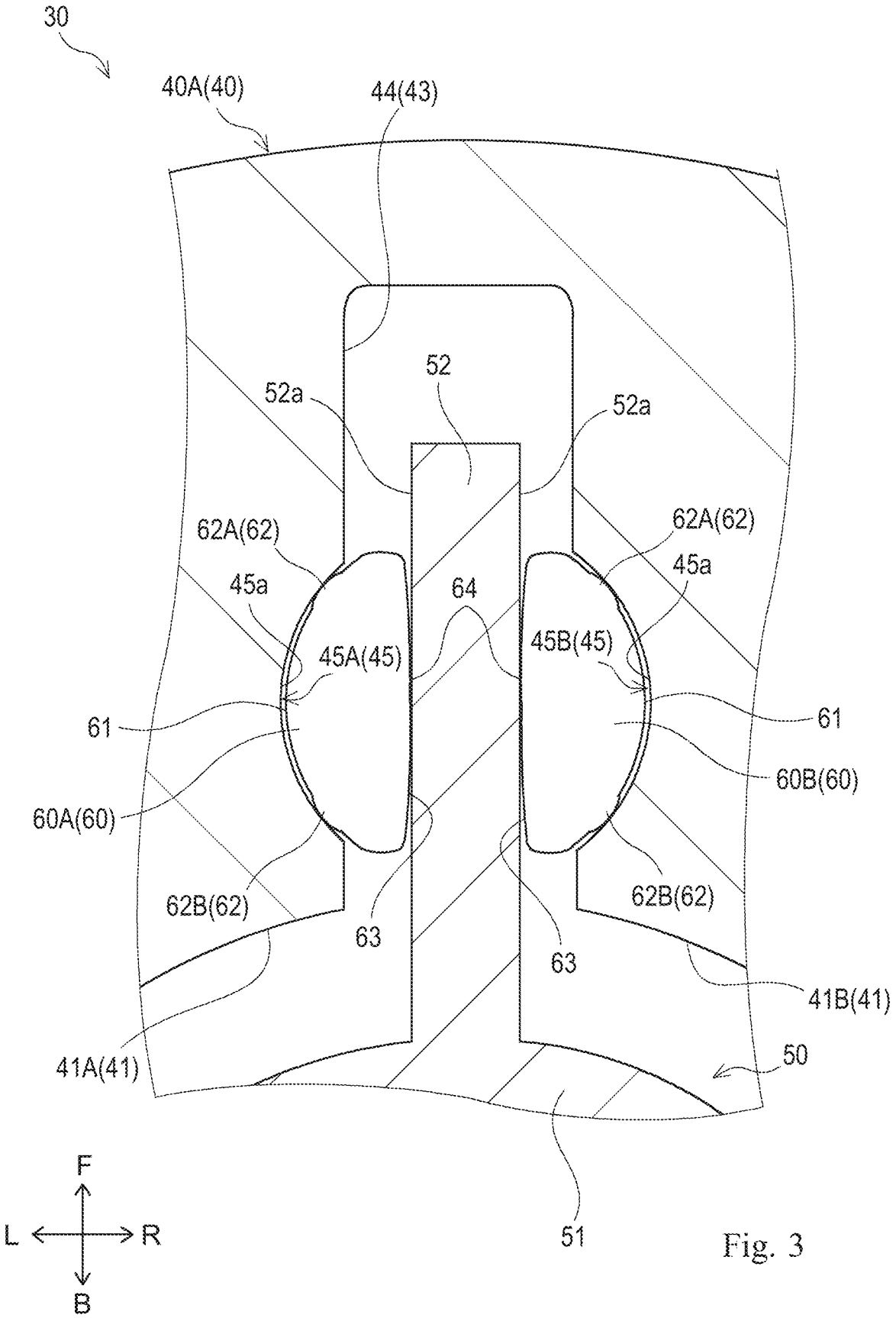
FIG. 3 is an enlarged plan cross sectional view illustrating the compression mechanism.

In the cylinder 40 illustrated in FIGS. 1 to 3, suction and compression of a refrigerant by the piston 50 are performed. The cylinder 40 is formed in a substantially cylindrical shape penetrating in the up-down direction. In the present embodiment, as illustrated in FIG. 1, the cylinders 40 are disposed between (upper side) the front head 31 and the middle plate 32 and between (lower side) the middle plate 32 and the rear head 33. Hereinafter, in a case where the upper and lower cylinders 40 are distinguished, the upper cylinder 40 is referred to as "upper cylinder 40A", and the lower cylinder 40 is referred to as "lower cylinder 40B". The cylinder 40 includes the cylinder chamber 41, a suction port 42, and a blade groove 43.

The upper cylinder 40A and the lower cylinder 40B have a configuration substantially similar to each other. Therefore, hereinafter, the configuration of the cylinder 40 will be described mainly using the upper cylinder 40A illustrated in FIGS. 2 and 3.

The cylinder chamber 41 illustrated in FIGS. 1 and 2 is a space in which suction and compression of a refrigerant are performed. The cylinder chamber 41 is formed so as to penetrate, in the up-down direction, the central part in plan view of the cylinder 40. The cylinder chamber 41 has an upper end part and a lower end part substantially closed by the front head 31 and the middle plate 32 (see FIG. 1).

The cylinder chamber 41 is partitioned into a high-pressure chamber 41A on a left side and a low-pressure chamber 41B on a right side by the piston 50 (blade 52). The high-pressure chamber 41A of the cylinder chamber 41 (the cylinder chamber 41 of the upper cylinder 40A) communicates with the discharge port 31*b* of the front head 31.

The suction port 42 suctions the refrigerant into the cylinder chamber 41. The suction port 42 is formed so as to radially penetrate the cylinder 40. The suction port 42 is formed so as to communicate with the low-pressure chamber 41B of the cylinder chamber 41. A suction pipe (not illustrated) through which the refrigerant flows outside the casing 10 is connected to the suction port 42.

The blade groove 43 illustrated in FIGS. 2 and 3 is a part through which the blade 52 of the piston 50 described later is inserted. The blade groove 43 is formed at the central part in the left-right direction of a front part of the cylinder 40. The blade groove 43 is formed so as to be recessed forward from a front part on an inner surface of the cylinder chamber 41. The blade groove 43 includes a back pressure chamber 44 and a bush hole 45.

The back pressure chamber 44 constitutes a main part of the blade groove 43. The back pressure chamber 44 is formed in a substantially rectangular shape elongated in the front-rear direction in plan view.

The bush hole 45 is a part in which the bush 60 described later is accommodated. A pair of the bush holes 45 are formed so as to be recessed outward in the left-right direction in an intermediate part in the front-rear direction of the blade groove 43. The bush hole 45 is formed in a substantially semicircular shape in plan view. The pair of bush holes 45 have inner surfaces 45*a* facing each other. The inner surface 45*a* constitutes a curved surface recessed outward in the left-right direction.

Hereinafter, in a case where the pair of bush holes 45 are distinguished, the bush hole 45 on the left side (high-pressure chamber 41A side) is referred to as "high-pressure-side bush hole 45A", and the bush hole 45 on the right side (low-pressure chamber 41B side) is referred to as "low-pressure-side bush hole 45B" (see FIG. 3).

The configuration of the cylinder 40 has been described above with the upper cylinder 40A. Here, the lower cylinder 40B is different from the upper cylinder 40A in being disposed between (lower side) the middle plate 32 and the rear head 33. Therefore, the cylinder chamber 41 of the lower cylinder 40B has an upper end part and a lower end part substantially closed by the middle plate 32 and the rear head 33 (see FIG. 1). The high-pressure chamber 41A of the cylinder chamber 41 of the lower cylinder 40B communicates with the discharge port 33*b* of the rear head 33.

The lower cylinder 40B is configured substantially similarly to the upper cylinder 40A except for the point described above. That is, the shape of the lower cylinder 40B is substantially similar to the shape of the upper cylinder 40A.

The piston 50 illustrated in FIGS. 1 to 3 compresses the refrigerant in the cylinder chamber 41. As illustrated in FIG. 2, the entire piston 50 is accommodated in the cylinder chamber 41 and the blade groove 43. By turning in the cylinder chamber 41 with the driving of the motor 20, the piston 50 compresses the refrigerant in the cylinder chamber 41. The thickness dimension (up-down dimension) of the piston 50 is formed substantially similarly to the thickness dimension (up-down dimension) of the cylinder 40. As illustrated in FIG. 1, the piston 50 is provided in each of the upper cylinder 40A and the lower cylinder 40B. The upper and lower pistons 50 have a configuration substantially similar to each other. Therefore, hereinafter, the configuration of the piston 50 will be described mainly using the upper piston 50. The piston 50 includes a main body 51 and the blade 52.

The main body 51 illustrated in FIG. 2 is a part accommodated in the cylinder chamber 41. The main body 51 is formed in a substantially cylindrical shape penetrating in the up-down direction. The outer diameter of the main body 51 is formed to be smaller than the inner diameter of the cylinder chamber 41. The main body 51 includes a shaft hole 51*a*.

The shaft hole 51*a* is a part through which the first eccentric portion 23 of the drive shaft 21 is inserted. The shaft hole 51*a* is provided with the first eccentric portion 23 rotatably about the rotation central axis of the drive shaft 21. In a state where the first eccentric portion 23 is inserted into the shaft hole 51*a*, the main body 51 and the drive shaft 21 are coupled in a relatively rotatable state.

The blade 52 is a part that protrudes in a radial direction (forward in FIG. 2) with respect to the main body 51. The blade 52 has at least a tip end part in a protruding direction inserted into the blade groove 43. The blade 52 is formed in a substantially rectangular shape in plan view. A width dimension (left-right dimension) of the blade 52 is formed smaller than a width dimension (left right dimension) of the blade groove 43.

The blade 52 partitions the inside of the cylinder chamber 41 into the high-pressure chamber 41A and the low-pressure chamber 41B together with the main body 51. With turning of the piston 50, the blade 52 moves forward and backward (reciprocates) through the blade groove 43 in the front-rear direction and rocks left and right. The blade 52 has left and right side surfaces 52*a* facing outward in the left-right direction. The side surface 52*a* is formed into a flat surface.

Figure 4:
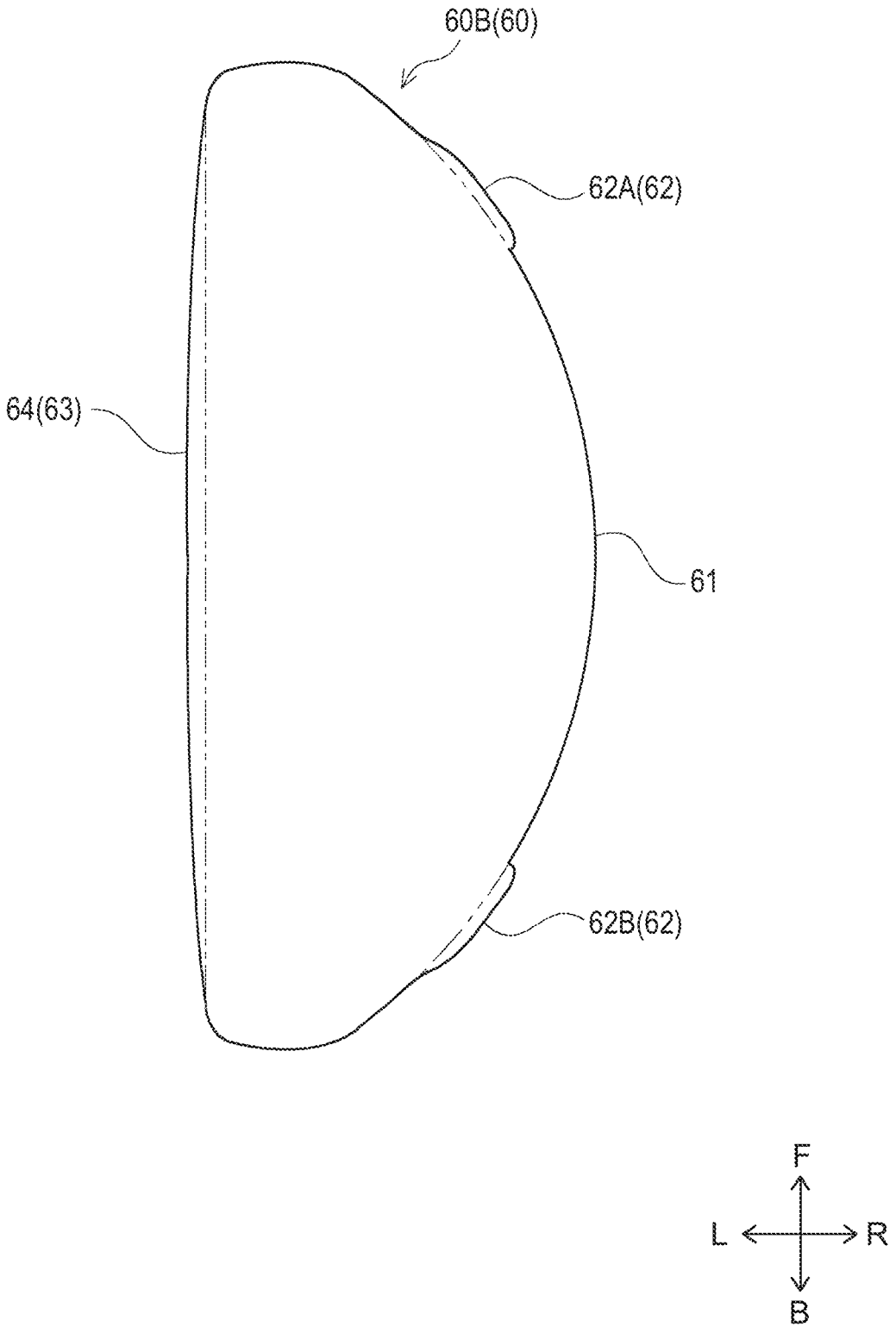
FIG. 4 is a plan view illustrating a bush.
Figure 5:
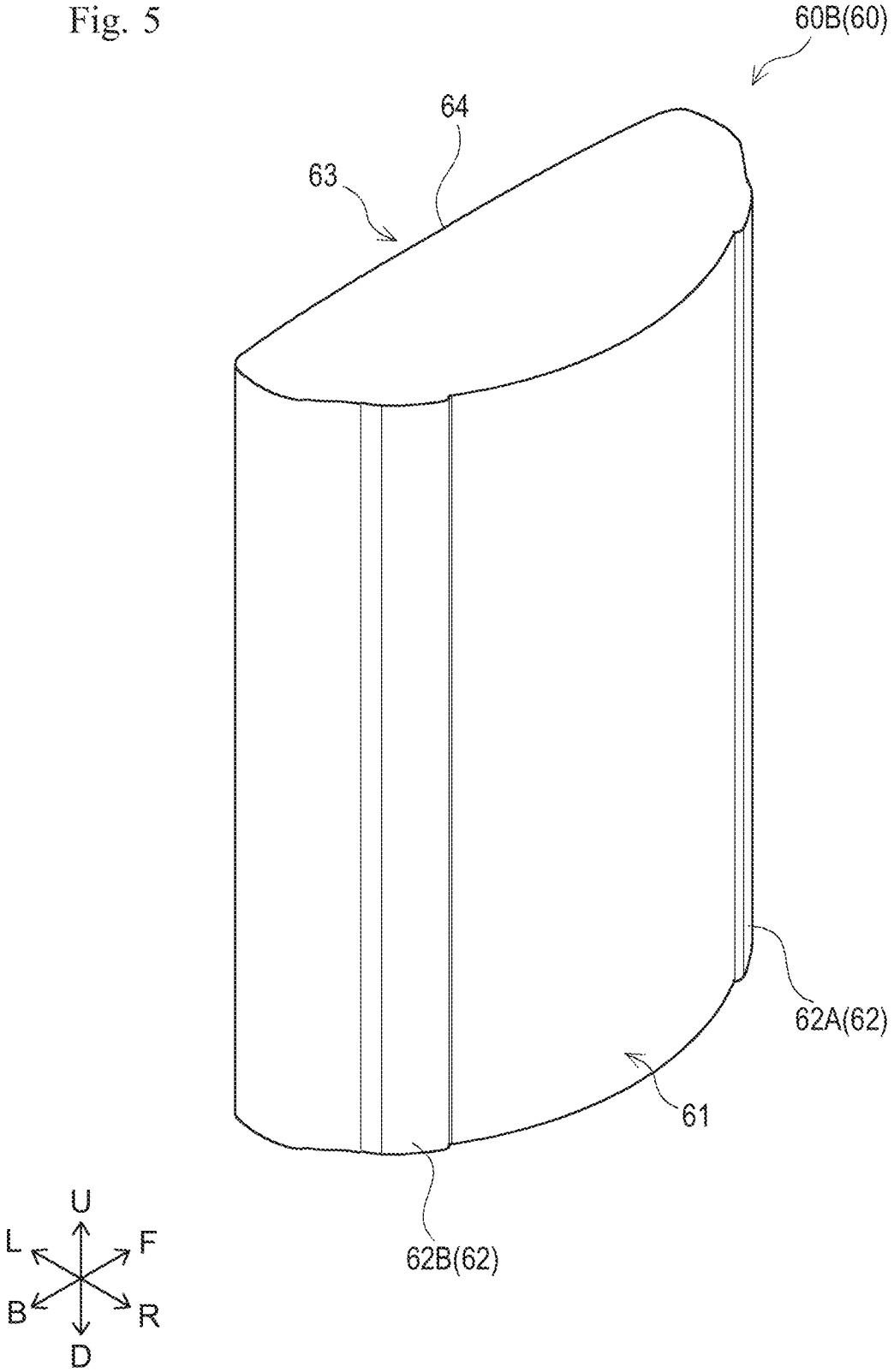
FIG. 5 is a perspective view illustrating the bush.

The bush 60 illustrated in FIGS. 2 to 7 slides with respect to the inner surface 45*a* of the bush hole 45 of the blade groove 43 and the side surface 52*a* of the blade 52. As illustrated in FIG. 5, the bush 60 is formed in a substantially semi-columnar shape. The up-down dimension of the bush 60 is formed substantially similarly to the thickness dimension (up-down dimension) of the cylinder 40 and the piston 50. The bush 60 is formed in a shape symmetrical front and rear. The bush 60 (total of four) is accommodated in each of the pair of bush holes 45 (the high-pressure-side bush hole 45A and the low-pressure-side bush hole 45B) of the upper cylinder 40A and the lower cylinder 40B. The bush 60 rocks along the inner surface 45*a* of the bush hole 45 with rocking of the blade 52.

Hereinafter, in a case where the pair of bushes 60 are distinguished, the bush 60 accommodated in the high-pressure-side bush hole 45A is referred to as "high-pressure-side bush 60A", and the bush 60 accommodated in the low-pressure-side bush hole 45B is referred to as "low-pressure-side bush 60B". The high-pressure-side bush 60A and the low-pressure-side bush 60B have shapes similar to each other. Hereinafter, the configuration of the bush 60 will be described using the low-pressure-side bush 60B. The bush 60 includes a first sliding surface 61 and a second sliding surface 63.

The first sliding surface 61 illustrated in FIGS. 3 to 6 is a surface that slides with the inner surface 45*a* of the bush hole 45. The first sliding surface 61 is formed to bulge outward in the left-right direction. The first sliding surface 61 is formed in a curved surface shape having a substantially semicircular shape in plan view. The first sliding surface 61 includes a first bulge 62.

Figure 6:
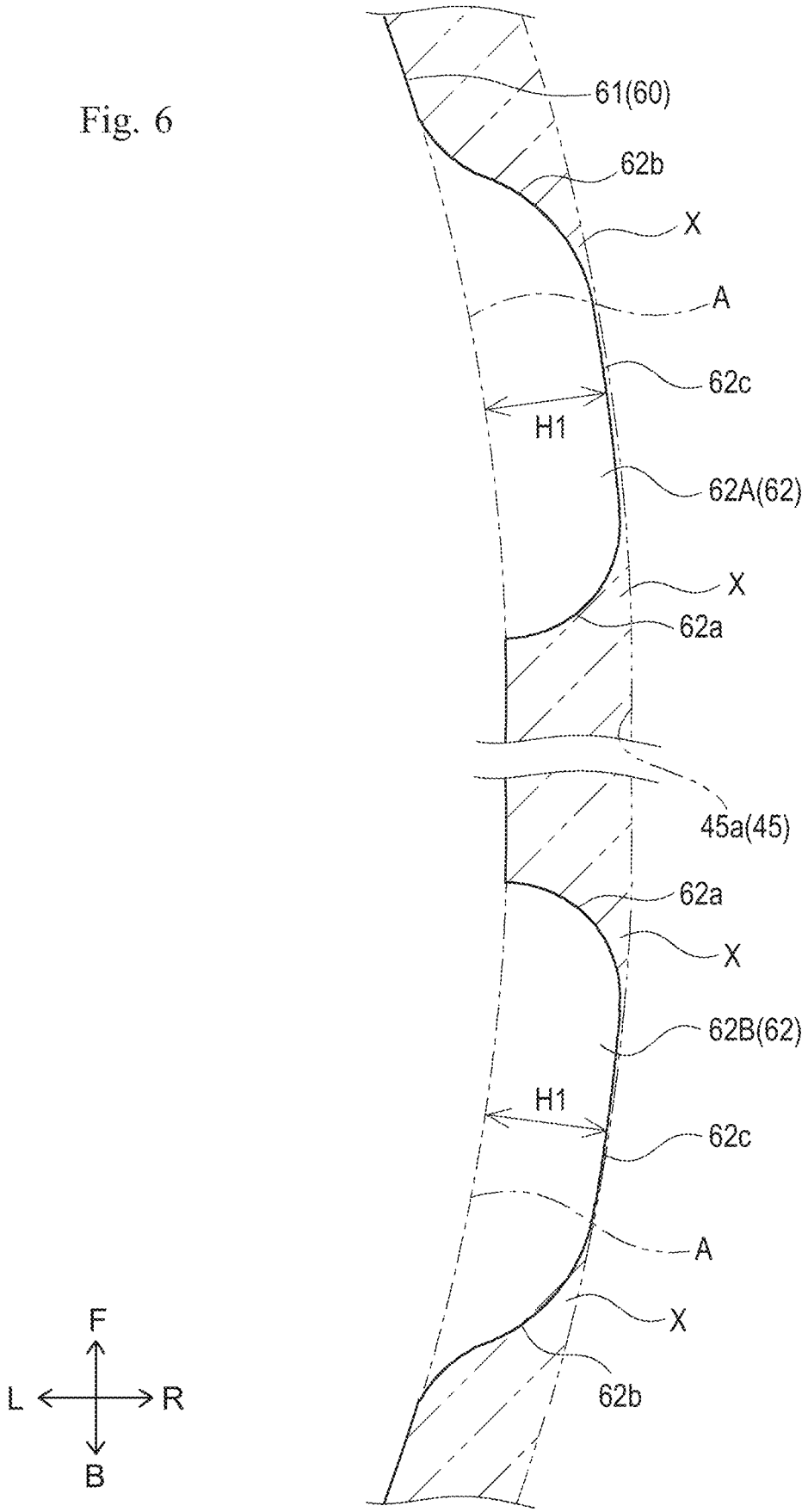
FIG. 6 is an enlarged plan view illustrating a first sliding surface of the bush.

The first bulge 62 illustrated in FIGS. 4 and 6 is a part bulging radially outward on the first sliding surface 61. More specifically, the first bulge 62 bulges radially outward relative to another part (part where the first bulge 62 is not formed) of the first sliding surface 61.

A pair of the first bulges 62 are provided so as to be positioned on both circumferential sides (both sides in the front-rear direction) in plan view of the first sliding surface 61. The pair of first bulges 62 are provided on a circumferential end part side (vicinity of the circumferential end part) in plan view of the first sliding surface 61. The pair of first bulges 62 are provided so as to be constantly in contact with the inner surface 45*a* regardless of the orientation of the bush 60 rocking in the bush hole 45 (see FIG. 8).

The pair of first bulges 62 are formed in a shape symmetrical front and rear to each other. Hereinafter, of the pair of first bulges 62, the first bulge 62 on the front side (anti-main body 51 side, radially outside of cylinder 40) is referred to as "front-side first bulge 62A", and the first bulge 62 on the rear side (main body 51 side, radially inside of cylinder 40) is referred to as "rear-side first bulge 62B".

The first sliding surface 61 (first bulge 62) is formed by appropriately performing cutting or the like on a part on the first sliding surface 61 side of the bush 60. That is, the first sliding surface 61 is formed by subjecting the bush 60 before processing to processing of removing the remaining part so as to form the first sliding surface 61. The first bulge 62 includes a first end part 62*a*, a second end part 62*b*, and a central part 62*c*.

The first end part 62*a* illustrated in FIG. 6 constitutes an end part on the center side in the front-rear direction of the bush 60 (side on which the pair of first bulges 62 face each other) in the first bulge 62. The first end part 62*a* is formed in a curved surface shape such that a gap X between the first end part 62*a* and the inner surface 45*a* of the bush hole 45 gradually decreases toward the circumferential center side in plan view of the first bulge 62.

The second end part 62*b* constitutes an end part on the anti-center side in the front-rear direction (side on which the pair of first bulges 62 is separated from each other) of the bush 60 in the first bulge 62. The second end part 62*b* is formed in a curved surface shape such that the gap X between the second end part 62*b* and the inner surface 45*a* of the bush hole 45 gradually decreases toward the circumferential center side in plan view of the first bulge 62. The second end part 62*b* constitutes a curved surface inclined more gently than the first end part 62*a* as a whole. The second end part 62*b* forms an S shaped curved surface in which a circumferential central part in plan view is steeper than other parts.

The central part 62*c* constitutes a circumferential central part in plan view of the first bulge 62. The central part 62*c* is formed in a smooth curved surface shape having a relatively large radius of curvature. As the radius of curvature of the central part 62*c*, substantially the same value as the radius of curvature of the inner surface 45*a* of the bush hole 45 can be adopted. The radius of curvature of the central part 62*c* may have a value smaller than that of the radius of curvature of the inner surface 45*a* of the bush hole 45.

The central part 62*c* (first bulge 62) is formed to have a height dimension H1 in a range of, for example, 2 to 5 μm. Here, the height dimension H1 of the first bulge 62 is a distance between a vertex of the central part 62*c* and an imaginary line A constituting a curved surface in a case of assuming that the first bulge 62 is not formed on the first sliding surface 61.

Figure 7:
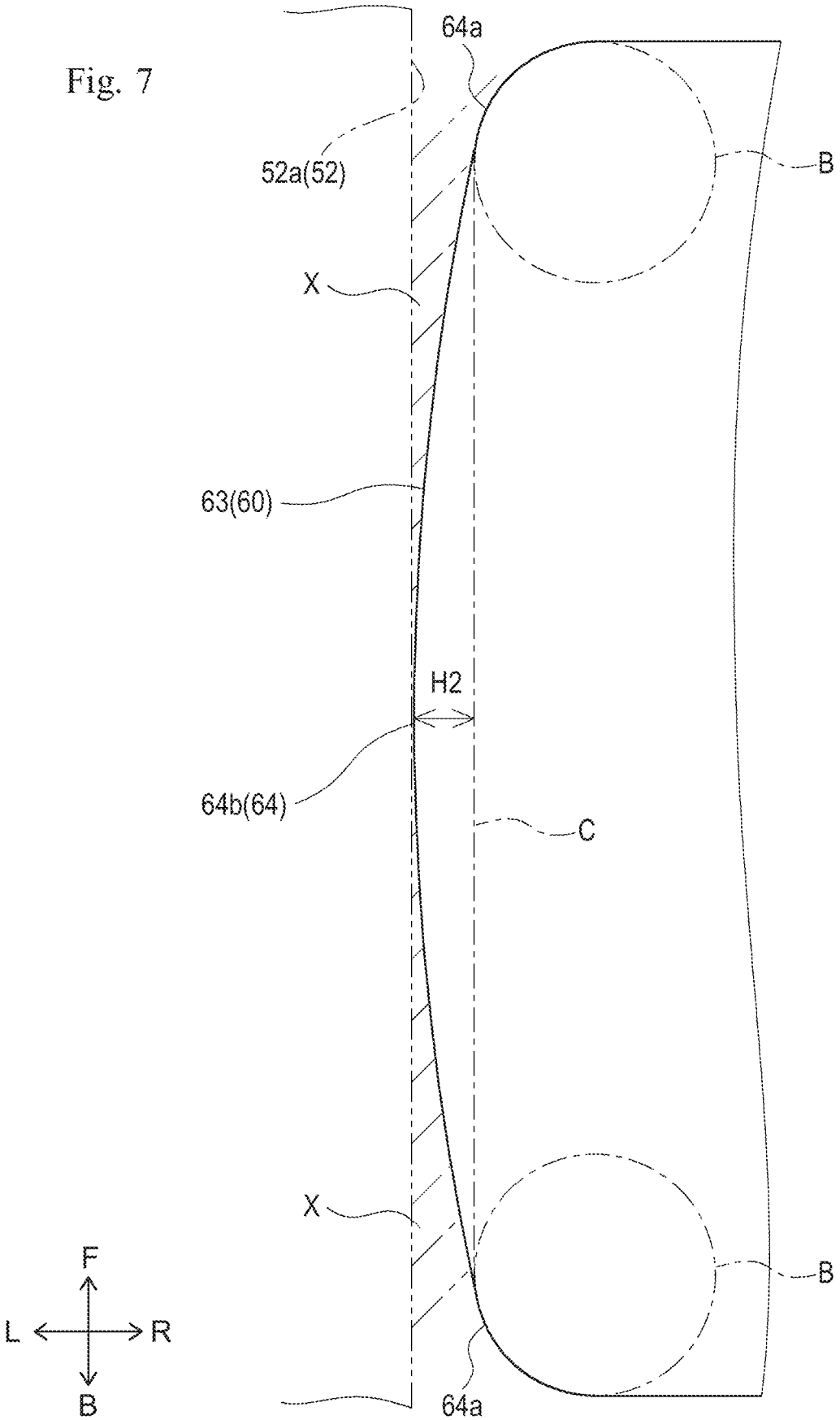
FIG. 7 is an enlarged plan view illustrating a second sliding surface of the bush.

The second sliding surface 63 illustrated in FIGS. 4 and 7 is a surface that slides with the side surface 52*a* of the blade 52. The second sliding surface 63 is formed so as to slightly bulge on the blade 52 side (left side in FIG. 7). The second sliding surface 63 includes a second bulge 64.

The second bulge 64 is a part bulging on the blade 52 side (left side in FIG. 7) on the second sliding surface 63. The second bulge 64 is formed by appropriately performing cutting or the like on a part on the second sliding surface 63 side of the bush 60. That is, the second bulge 64 is formed by subjecting the bush 60 before processing to processing of removing the remaining part so as to form the second bulge 64. The second bulge 64 includes an end part 64*a* and a central part 64*b*.

The end part 64*a* illustrated in FIG. 7 constitutes an end part on the front-rear direction end part side of the bush 60 in the second bulge 64. The end part 64*a* is formed in a curved surface shape having a relatively small radius of curvature. The end part 64*a* is formed in a curved surface shape such that the gap X between the end part 64*a* and the side surface 52*a* of the blade 52 gradually decreases toward the circumferential center side in plan view of the second sliding surface 63.

The central part 64*b* constitutes a circumferential central part of the second bulge 64 in plan view. The central part 64*b* is formed in a curved surface shape having a relatively large radius of curvature with the circumferential central part in plan view as a vertex. The radius of curvature of the central part 64*b* is formed to be larger than the radius of curvature of the end part 64*a*. The central part 64*b* is formed in a curved surface shape such that the gap X between the central part 64*b* and the side surface 52*a* of the blade 52 gradually decreases toward the circumferential center side in plan view of the second sliding surface 63.

The central part 64*b* is formed to have a height dimension H2 in a range of, for example, 2 to 5 μm. Here, the height dimension H2 of the second bulge 64 is a distance from an imaginary line C connecting respective contact points of a pair of imaginary lines B constituting a circle having the radius of curvature of the end part 64*a* and the central part 64*b* to the vertex of the central part 64*b*.

Next, the operation of the compression mechanism 30 will be described with reference to FIGS. 2 and 8. Hereinafter, the operation of the compression mechanism 30 will be described focusing on the upper cylinder 40A.

When the drive shaft 21 of the motor 20 illustrated in FIG. 2 is rotated clockwise in plan view, the piston 50 (main body 51) turns (rotates) clockwise in plan view in the cylinder chamber 41 of the cylinder 40 (upper cylinder 40A) with rotation of the first eccentric portion 23 of the drive shaft 21. With turning of the piston 50, the volume of the low-pressure chamber 41B on the right side of the cylinder chamber 41 increases, whereby the refrigerant from the suction pipe (not illustrated) is suctioned into the cylinder chamber 41 through the suction port 42.

With further turning of the piston 50, the volume decreases on the left side of the cylinder chamber 41, thereby forming the high-pressure chamber 41A that compresses the suctioned refrigerant. Note that at this time, since the volume increases in the low-pressure chamber 41B on the right side of the cylinder chamber 41, a new refrigerant is suctioned into the low-pressure chamber 41B.

When the refrigerant is compressed in the high-pressure chamber 41A, the discharge valve (not illustrated) of the discharge port 31*b* of the front head 31 is opened by the pressure of the refrigerant, and the refrigerant is discharged into the casing 10 through the discharge port 31*b*. The refrigerant discharged into the casing 10 is fed into the refrigerant circuit (not illustrated) through the discharge pipe (not illustrated).

In this manner, the compression mechanism 30 compresses the refrigerant in the cylinder chamber 41 by the turning of the piston 50. With the operation of the piston 50, the blade 52 in the blade groove 43 moves forward and backward and rocks left and right. With the operation of the blade 52, the bush 60 slides with respect to the inner surface 45*a* of the bush hole 45 and the side surface 52*a* of the blade 52.

Here, the inside of the back pressure chamber 44 of the cylinder 40 is increased in pressure by the refrigerant in the casing 10 and is filled with the lubricant Y that circulates in the refrigerant circuit together with the refrigerant. An oil film by the lubricant Y drawn from the back pressure chamber 44 is formed between the bush 60 and a member (the inner surface 45*a* of the bush hole 45 and the side surface 52*a* of the blade 52) that becomes a sliding target of the bush 60.

Hereinafter, sliding of the bush 60 will be described with reference to FIGS. 8 and 9. Hereinafter, sliding of the bush 60 will be described focusing on the low-pressure-side bush 60B.

Figure 8:
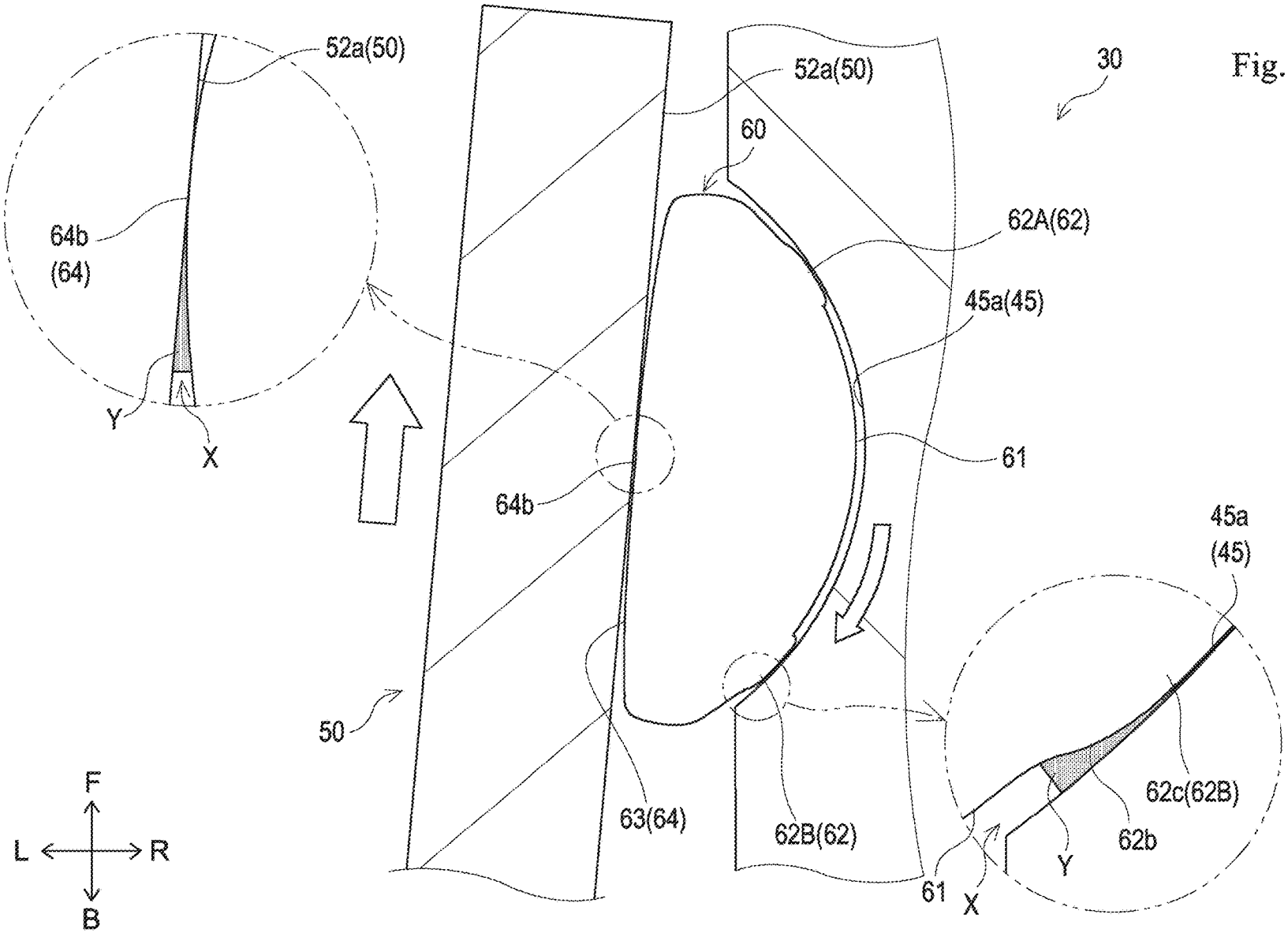
FIG. 8 is an enlarged plan cross-sectional view illustrating operation of the compression mechanism in a case where the bush rocks backward as a blade moves forward.
Figure 9:
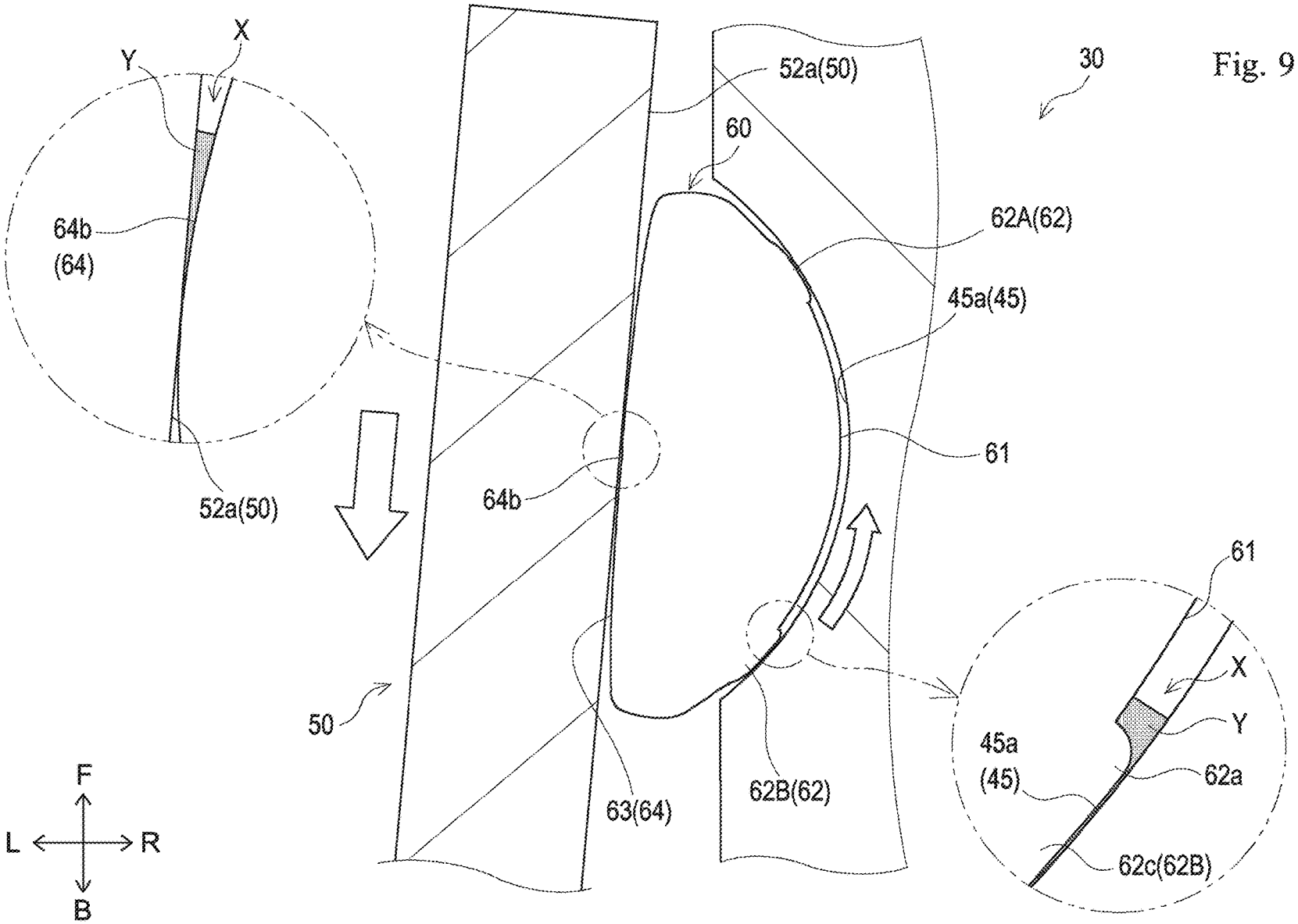
FIG. 9 is an enlarged plan cross-sectional view illustrating operation of the compression mechanism in a case where the bush rocks forward as a blade moves backward.

As illustrated in FIGS. 8 and 9, with turning of the piston 50, the blade 52 moves forward and backward (reciprocates) in the front-rear direction through the blade groove 43. Along with this, the second sliding surface 63 of the bush 60 slides in the front-rear direction with the side surface 52*a* of the blade 52.

Here, the gap X due to the second bulge 64 is formed between the second sliding surface 63 of the bush 60 and the side surface 52*a* of the blade 52. The gap X is formed so as to gradually decrease (in a wedge shape) toward the circumferential center side in plan view of the second sliding surface 63. When the bush 60 and the blade 52 slide in the front-rear direction in this state, the lubricant Y is drawn into the circumferential center side in plan view of the second sliding surface 63 (second bulge 64). At this time, a wedge effect can promote the formation of an oil film between the second sliding surface 63 and the side surface 52*a* of the blade 52.

Specifically, in a case where the blade 52 moves forward as illustrated in FIG. 8 for example, the lubricant Y between the second sliding surface 63 and the side surface 52*a* is drawn into the circumferential center side (front side) in plan view of the second sliding surface 63 along with the movement of the blade 52. Here, since the gap X having a wedge shape described above is formed between the second sliding surface 63 and the side surface 52*a*, the formation of the oil film between the second sliding surface 63 and the side surface 52*a* can be effectively promoted by the wedge effect. This can generate oil film pressure between the second sliding surface 63 and the side surface 52*a*, and can suppress generation of galling and seizure.

Also in a case where the blade 52 moves rearward as illustrated in FIG. 9, the lubricant Y between the second sliding surface 63 and the side surface 52*a* is drawn into the circumferential center side (rear side) in plan view of the second sliding surface 63 similarly to the above along with the movement of the blade 52. Also in this case, the wedge effect due to the gap X between the second sliding surface 63 and the side surface 52*a* can effectively promote the formation of the oil film between the second sliding surface 63 and the side surface 52*a*, and can suppress generation of galling and seizure.

With turning of the piston 50, the blade 52 rocks in the left right direction. Along with this, the bush 60 rocks along the inner surface 45*a* of the bush hole 45 in a state of being accommodated in the bush hole 45. At this time, the first sliding surface 61 of the bush 60 slides in the circumferential direction in plan view between the inner surface 45*a* of the bush hole 45 and the inner surface 45*a* (first sliding surface 61).

Here, the gap X by the first bulge 62 is formed between the first sliding surface 61 of the bush 60 and the inner surface 45*a* of the bush hole 45. The gap X is formed so as to gradually decrease (in a wedge shape) toward the circumferential center side in plan view of the first bulge 62. Due to the bush 60 and the bush hole 45 circumferentially sliding in this state, the lubricant Y is drawn into the circumferential center side in plan view of the first bulge 62. At this time, a wedge effect can promote the formation of an oil film between the first sliding surface 61 and the inner surface 45*a* of the bush hole 45.

Specifically, in a case where the bush 60 rocks clockwise in plan view as illustrated in FIG. 8 for example, the lubricant Y between the first sliding surface 61 and the inner surface 45*a* is drawn into the circumferential center side in plan view of the first bulge 62 along with the rocking of the bush 60. Here, as illustrated in the enlarged view of FIG. 8, the gap X having a wedge shape described above is formed between the rear-side first bulge 62B (the second end part 62*b* and the central part 62*c*) of the first sliding surface 61 and the inner surface 45*a*. The gap X having a wedge shape is similarly formed also between the front-side first bulge 62A (the first end part 62*a* and the central part 62*c*) and the inner surface 45*a*. Due to this, the wedge effect of the gap X can effectively promote the formation of the oil film between the first sliding surface 61 and the inner surface 45*a*. This can generate oil film pressure between the first sliding surface 61 and the inner surface 45*a*, and can suppress generation of galling and seizure.

Also in a case where the bush 60 rocks counterclockwise in plan view as illustrated in FIG. 9, the lubricant Y between the first sliding surface 61 and the inner surface 45*a* is drawn toward the circumferential center side in plan view of the first bulge 62 along with the rocking of the bush 60 similarly to the above. Here, as illustrated in the enlarged view of FIG. 9, the gap X having a wedge shape is formed between the rear-side first bulge 62B (the first end part 62*a* and the central part 62*c*) of the first sliding surface 61 and the inner surface 45*a*. The gap X having a wedge shape is similarly formed also between the front-side first bulge 62A (the second end part 62*b* and the central part 62*c*) and the inner surface 45*a*. Due to this, the wedge effect of the gap X can effectively promote the formation of the oil film between the first sliding surface 61 and the inner surface 45*a*, and can suppress generation of galling and seizure.

In the present embodiment, the pair of first bulges 62 (the front-side first bulge 62A and the rear-side first bulge 62B) are provided so as to be positioned on both circumferential end sides in plan view of the first sliding surface 61 of the bush 60. This can effectively promote the formation of the oil film on both circumferential end sides in plan view of the first sliding surface 61 of the bush 60. In particular, forming the rear-side first bulge 62B can effectively promote the formation of the oil film on the main body 51 side (inner side) of the piston 50 that is relatively far from the back pressure chamber 44 and where the oil film is easily broken.

In the present embodiment, the inclination of the curved surface of the first end part 62*a* is formed steeper than that of the second end part 62*b*. This makes it easy to hold the lubricant Y between the pair of first bulges 62.

In the present embodiment, the bush 60 is formed in a shape symmetrical front and rear. This can suppress the bush 60 from being assembled with a wrong orientation when the bush 60 is assembled to the bush hole 45.

In the present embodiment, the first bulge 62 and the second bulge 64 that generate the wedge effect are formed in the bush 60. In this case, unlike a case where the wedge effect is generated on the sliding target member (e.g., the bush hole 45) side of the bush 60 for example, the position of the gap X having a wedge shape with respect to the inner surface 45*a* of the bush hole 45 moves with rocking of the bush 60. Due to this, an oil film can be formed at a part to which a load is easily applied along with the rocking of the bush 60, and the wedge effect can be effectively generated. In this manner, the wedge effect can be generated with reference to the position of the bush 60.

In the present embodiment, the front-side first bulge 62A and the rear-side first bulge 62B have curved surface shapes different from each other on both sides in the circumferential direction in plan view (see the first end part 62*a* and the second end part 62*b*). This can provide a difference in the degree of generation of the wedge effect depending on the ease of application of the load to the sliding portion. For example, in a case where the bush 60 illustrated in FIG. 8 rocks clockwise in plan view, if a load is relatively easily applied to the rear-side first bulge 62B side of the front-side first bulge 62A and the rear-side first bulge 62B, the wedge effect can be easily generated on the rear-side first bulge 62B (second end part 62*b*) side than on the front-side first bulge 62A (first end part 62*a*).

The configurations (shape, height, and the like) of the first bulge 62 and the second bulge 64 are not limited to those described above.

For example, the positions where the first end part 62*a* and the second end part 62*b* of the first bulge 62 are formed may be interchanged. That is, the first bulge 62 may be reversed front and rear.

Figure 10:
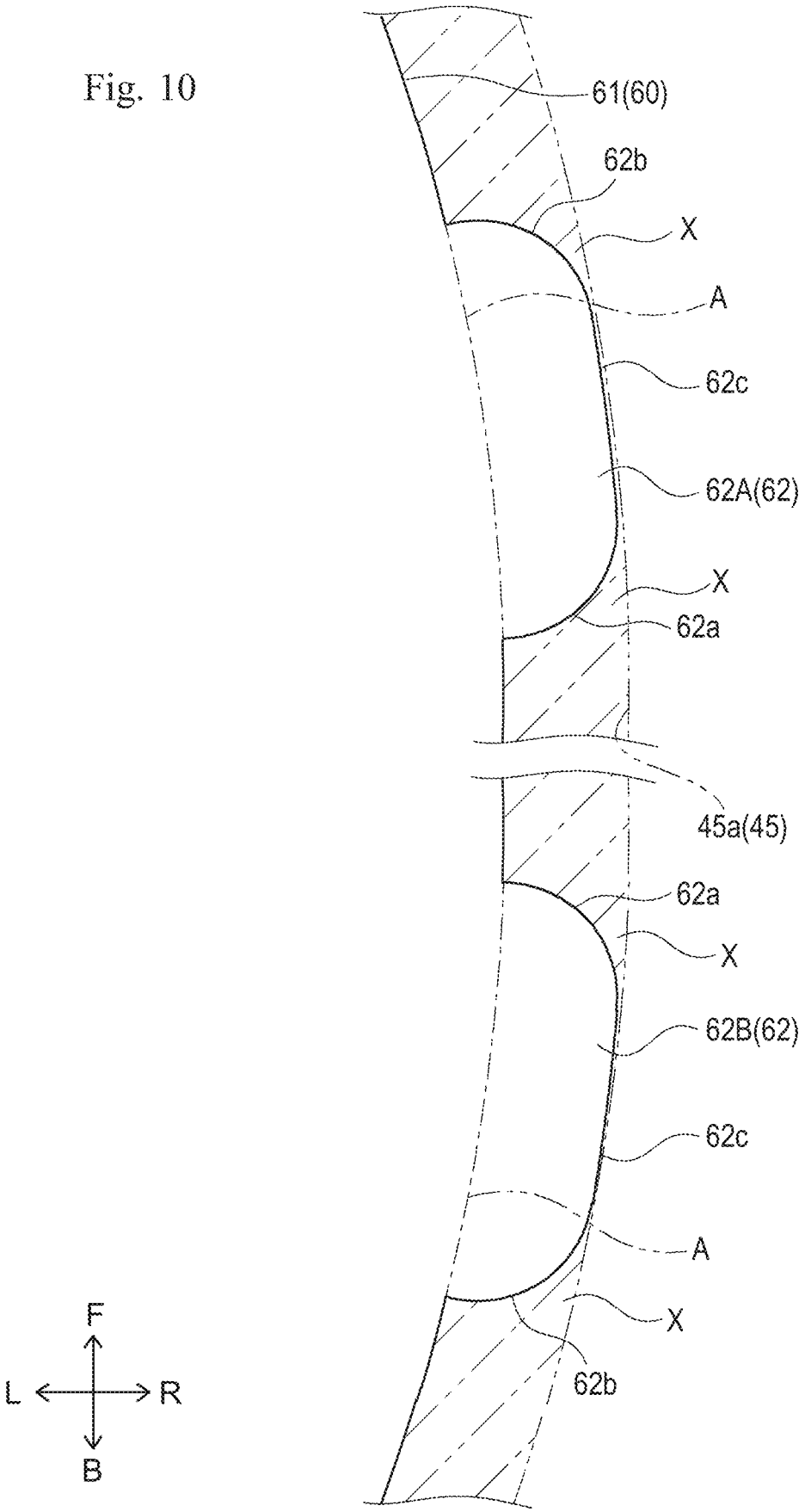
FIG. 10 is an enlarged plan view illustrating a modification of the first sliding surface.

In the present embodiment, the shapes of the first end part 62*a* and the second end part 62*b* of the first bulge 62 are different from each other, but the present invention is not limited to such aspect. For example, as in the modification illustrated in FIG. 10, the first end part 62*a* and the second end part 62*b* of the first bulge 62 may have the shape same as each other. That is, the first bulge 62 may be formed in a shape symmetrical front and rear.

For example, a recess functioning as an oil reservoir may be formed at a predetermined position (e.g., vertex) of the first bulge 62 and the second bulge 64. This can suppress the oil film from breaking by holding the lubricant Y in the recess, and can suppress generation of galling and seizure.

The configurations of the first bulge 62 and the second bulge 64 are not limited to those in the above-described example, and can be appropriately changed from the viewpoint of effectively promoting the formation of an oil film.

As described above, the compression mechanism 30 according to the present embodiment includes: the cylinder 40 including the cylinder chamber 41 and the blade groove 43 communicating with the cylinder chamber 41; the piston 50 including the blade 52 that partitions the cylinder chamber 41 into the high-pressure chamber 41A and the low-pressure chamber 41B and is inserted into the blade groove 43 so as to be movable forward and backward, the piston 50 turnably provided in the cylinder chamber 41; and the bush 60 rockably accommodated in the bush hole 45 formed in the blade groove 43 and including the first sliding surface 61 that slides with the inner surface 45*a* of the bush hole 45 and the second sliding surface 63 that slides with the side surface 52*a* of the blade, in which the compression mechanism 30 includes at least one of the first oil film formation portion (first bulge 62) formed on one of the first sliding surface 61 and the inner surface 45*a* such that the gap X between the first sliding surface 61 and the inner surface 45*a* gradually decreases toward a direction in which the lubricant Y is drawn between the first sliding surface 61 and the inner surface 45*a* along with rocking of the bush 60, and a second oil film formation portion (second bulge 64) formed on the second sliding surface 63 such that the gap X between the second sliding surface 63 and the side surface 52*a* gradually decreases toward a direction in which the lubricant Y is drawn between the second sliding surface 63 and the side surface 52*a* along with forward and backward movement of the blade.

Such configuration can suppress galling and seizure. That is, by providing the first oil film formation portion (first bulge 62) or the second oil film formation portion (second bulge 64), due to the wedge effect, the lubricant Y can be gradually easily introduced between the first sliding surface 61 and the inner surface 45*a* or between the second sliding surface 63 and the side surface 52*a*. This effectively promotes formation of an oil film between the bush 60 and the bush hole 45 or between the bush 60 and the blade 52, and can suppress galling and seizure.

The first oil film formation portion (first bulge 62) is formed so as to bulge on the inner surface 45*a* side on the first sliding surface 61.

With such configuration, the first oil film formation portion (first bulge 62) formed so as to bulge on the first sliding surface 61 of the bush 60 can promote the formation of an oil film. Since the bush 60 is provided with the first oil film formation portion (first bulge 62), it is possible to promote the formation of the oil film regardless of the position of the bush 60 with respect to the sliding object (bush hole 45) of the bush 60.

Both the first oil film formation portion (first bulge 62) and the second oil film formation portion (second bulge 64) are included.

Such configuration can effectively promote the formation of oil films on both the first sliding surface 61 and the second sliding surface 63 of the bush 60. That is, providing both the first oil film formation portion (first bulge 62) and the second oil film formation portion (second bulge 64) can effectively promote the formation of oil films between the bush 60 and the bush hole 45 and between the bush 60 and the blade 52.

The second oil film formation portion (second bulge 64) is formed so as to bulge on the side surface 52*a* side on the second sliding surface 63.

With such configuration, the second oil film formation portion (second bulge 64) formed so as to bulge on the second sliding surface 63 of the bush 60 can promote the formation of an oil film. Since the bush 60 is provided with the second oil film formation portion (second bulge 64), it is possible to promote the formation of the oil film regardless of the position of the bush 60 with respect to the sliding object (blade 52) of the bush 60.

The pair of first oil film formation portions (first bulges 62) are formed so as to be positioned on both end sides in a sliding direction of the first sliding surface 61 (both end sides in the circumferential direction in plan view of the first sliding surface 61).

Such configuration can promote the formation of an oil film on both end sides in the sliding direction of the first sliding surface 61. That is, forming a pair of the first oil film formation portions (first bulges 62) so as to be positioned on both end sides in the sliding direction of the first sliding surface 61 can promote the formation of an oil film on both end sides in the sliding direction of the first sliding surface 61. With such configuration, in the first sliding surface 61, the first oil film formation portion (the rear-side first bulge 62B) formed on the main body 51 side of the piston 50 where the oil film is easily broken can promote the formation of the oil film in a part where the oil film is easily broken.

Note that the first bulge 62 is an embodiment of the first oil film formation portion.

The second bulge 64 is an embodiment of the second oil film formation portion.

While the first embodiment of the present invention has been described above, the present invention is not limited to the above configuration, and various modifications can be made within the scope of the invention described in the claims.

Figure 11:
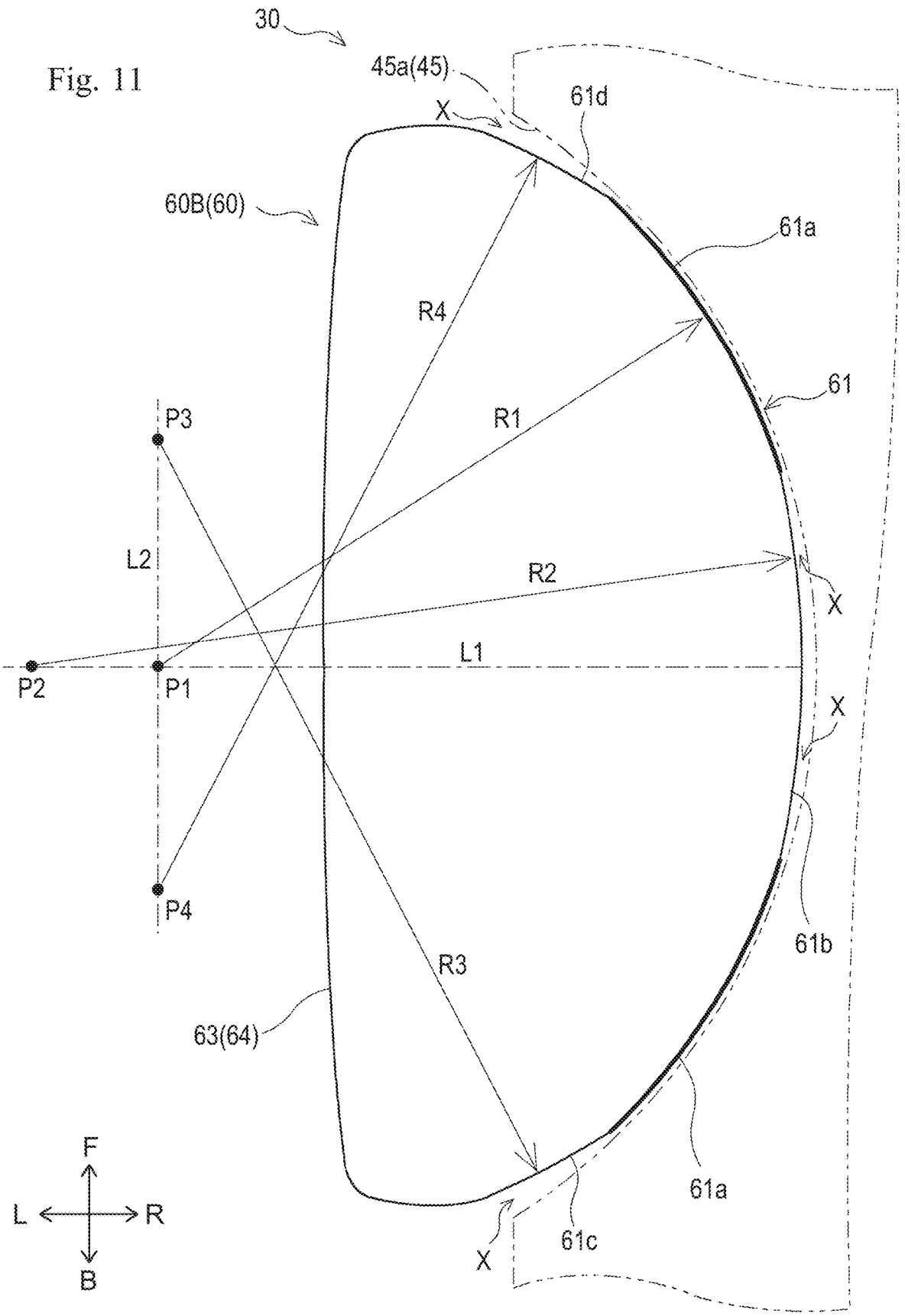
FIG. 11 is an enlarged plan view illustrating a bush of a compression mechanism according to a second embodiment of the present invention.

For example, the shape of the first sliding surface 61 of the bush 60 may be the same as that of the second embodiment illustrated in FIG. 11. In the bush 60 of the compression mechanism 30 according to the second embodiment, the first sliding surface 61 is formed of a curved surface having a different radius of curvature, whereby the gap X having a wedge shape is formed between the first sliding surface 61 and the inner surface 45*a* of the bush hole 45. Hereinafter, the configuration of the first sliding surface 61 of the bush 60 according to the second embodiment will be described with the low-pressure-side bush 60B. In the present embodiment, the first sliding surface 61 has a sliding curved surface portion 61*a*, a central curved surface portion 61*b*, a rear curved surface portion 61*c*, and a front curved surface portion 61*d*.

The sliding curved surface portion 61*a* is a part curved along the sliding direction (circumferential direction) of the bush 60 in plan view. The sliding curved surface portion 61*a* has a curved surface shape (arc shape) in plan view formed in a curved surface shape having a radius R1 of curvature substantially the same as the radius of curvature of the bush hole 45. A pair of the sliding curved surface portions 61*a* are provided at intervals so as to be positioned on both sides in the circumferential direction (both sides in the front-rear direction) in plan view of the first sliding surface 61. Note that in FIG. 11, the first sliding surface 61 is indicated by a thick line.

In FIG. 11, the center in plan view of the bush hole 45 (arc center of the first sliding surface 61) is indicated by a point P1. The point P1 is located on an imaginary line L1 along the height direction of the bush 60 (the line direction connecting the vertex of the first sliding surface 61 and the vertex of the second sliding surface 63) in plan view. In FIG. 11, the height direction of the bush 60 is oriented in the left-right direction.

The central curved surface portion 61*b* is a part circumferentially adjacent to the pair of sliding curved surface portions 61*a* between the pair of sliding curved surface portions 61*a*. The central curved surface portion 61*b* has a curved surface shape (arc shape) in plan view formed in a curved surface shape having a radius R2 of curvature larger than the radius of curvature (radius R1 of curvature) of the bush hole 45. In FIG. 11, the arc center of the central curved surface portion 61*b* is indicated by a point P2. The point P2 is located leftward relative to the point P1 on the imaginary line L1.

The rear curved surface portion 61*c* is a part adjacent circumferentially to a rear part of the sliding curved surface portion 61*a* on the rear side. The rear curved surface portion

61*c* has a curved surface shape (arc shape) in plan view formed in a curved surface shape having a radius R3 of curvature larger than the radius of curvature (radius R1 of curvature) of the bush hole 45. The radius R3 of curvature is formed larger than the radius R2 of curvature. In FIG. 11, the arc center of the rear curved surface portion 61*c* is indicated by a point P3. The point P3 is located forward relative to the point P1 on an imaginary line L2 passing through the point P1 and orthogonal to the imaginary line L1.

The front curved surface portion 61*d* is a part adjacent circumferentially to a front part of the sliding curved surface portion 61*a* on the front side. The front curved surface portion 61*d* has a curved surface shape (arc shape) in plan view formed in a curved surface shape having a radius R4 of curvature larger than the radius of curvature (radius R1 of curvature) of the bush hole 45. The radius R4 of curvature is formed to have the same size as the radius R3 of curvature. In FIG. 11, the arc center of the front curved surface portion 61*d* is indicated by a point P4. The point P4 is located rearward relative to the point P1 on the imaginary line L2.

According to the present embodiment, by forming the shape of the first sliding surface 61 as described above, the gap X between the first sliding surface 61 and the inner surface 45*a* can be gradually decreased from the curved surface portion (the central curved surface portion 61*b*, the rear curved surface portion 61*c*, and the front curved surface portion 61*d*) having a relatively large radius of curvature toward the adjacent sliding curved surface portion 61*a*. Due to this, substantially similarly to the bush 60 according to the first embodiment, the wedge effect of the gap X can effectively promote the formation of the oil film between the first sliding surface 61 and the inner surface 45*a*, and can suppress generation of galling and seizure. According to the present embodiment, it is possible to secure a relatively large sliding area with respect to the inner surface 45*a* in the sliding curved surface portion 61*a*. According to the present embodiment, it is possible to relatively reduce the processing amount (the amount of the part to be removed from the bush 60 before processing) in a case of forming the first sliding surface 61 by cutting or the like, and to relatively easily form the sliding curved surface portion 61*a*.

Note that in the present embodiment, an example in which the radius R1 of curvature is formed to be substantially the same as the radius of curvature of the bush hole 45 has been described, but the present invention is not limited to such aspect. For example, the radius R1 of curvature may be formed to be smaller than the radius of curvature of the bush hole 45. The radius R1 of curvature may be formed to be larger than the radius of curvature of the bush hole 45. In the present embodiment, an example in which the radii R3 and R4 of curvature are formed larger than the radius R2 of curvature has been described, but the present invention is not limited to such aspect. For example, the radii R3 and R4 of curvature may be formed to be smaller than the radius R2 of curvature, and the radii R2, R3, and R4 of curvature may be formed to have the same size as one another. The positions of the points P1 to 4 in the present embodiment are an example, and as the positions of the points P1 to 4, an appropriate position can be set within a range in which the gap X having a wedge shape can be formed between the first sliding surface 61 and the inner surface 45*a*.

As described above, in the compression mechanism 30 according to the present embodiment, the first sliding surface 61 includes the first curved surface portion (the sliding curved surface portion 61*a*) curved along the sliding direction and the second curved surface portion (the central curved surface portion 61*b*, the rear curved surface portion 61*c*, and the front curved surface portion 61*d*) adjacent in the sliding direction to the first curved surface (the sliding curved surface portion 61*a*), and the first oil film formation portion (the sliding curved surface portion 61*a*, the central curved surface portion 61*b*, the rear curved surface portion 61*c*, and the front curved surface portion 61*d*) is formed on the first sliding surface 61 by making the radius of curvature of the second curved surface portion (the central curved surface portion 61*b*, the rear curved surface portion 61*c*, and the front curved surface portion 61*d*) larger than the radius of curvature of the first curved surface (the sliding curved surface portion 61*a*).

Such configuration can relatively easily form the first oil film formation portion (sliding curved surface portion 61*a*, central curved surface portion 61*b*, rear curved surface portion 61*c*, and front curved surface portion 61*d*). That is, it is possible to relatively reduce the processing amount (the amount of the part to be removed from the bush 60 before processing) in a case of forming the first oil film formation portion (the sliding curved surface portion 61*a*, the central curved surface portion 61*b*, rear curved surface portion 61*c*, and the front curved surface portion 61*d*) by cutting or the like.

Figure 12:
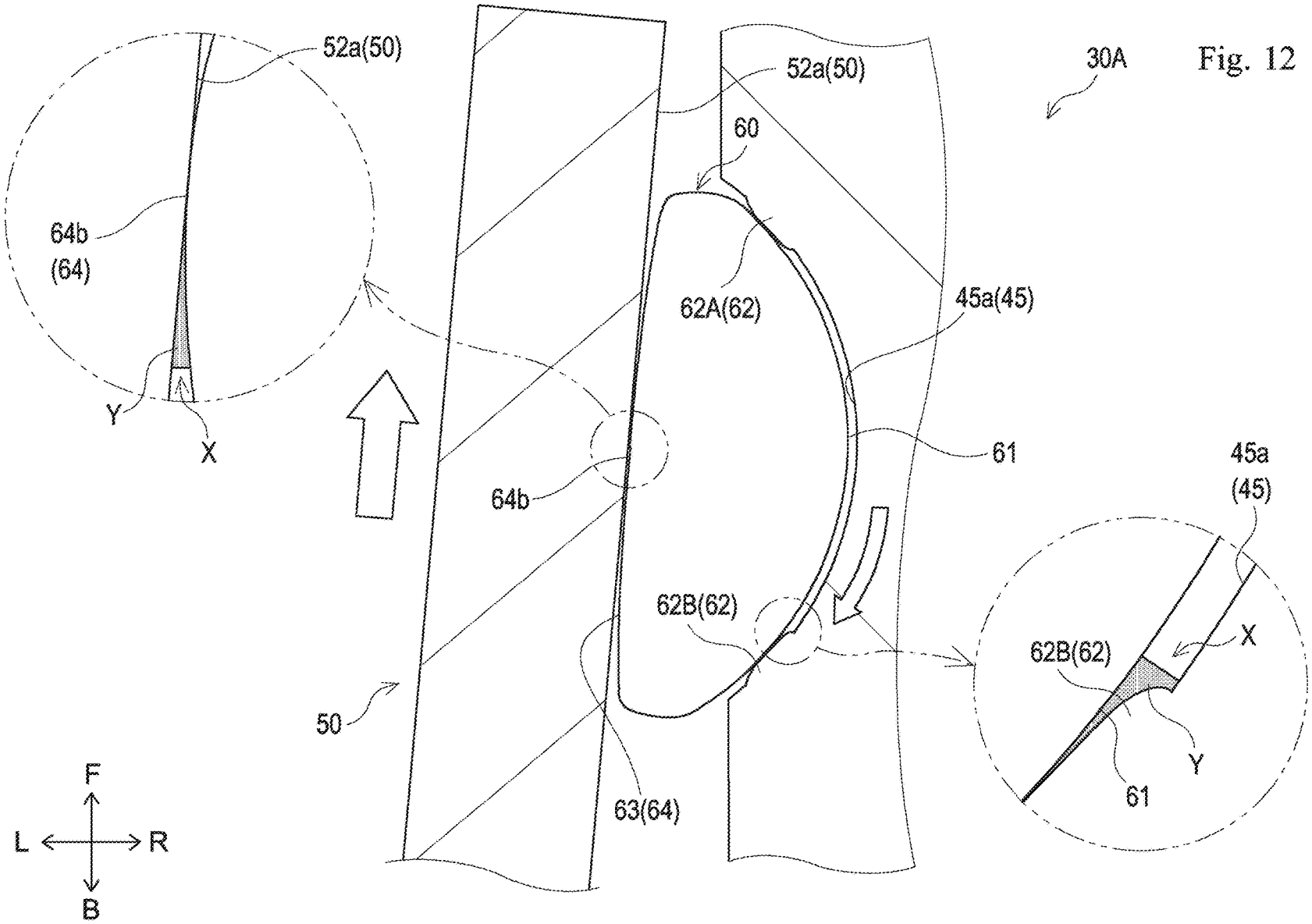
FIG. 12 is an enlarged plan cross-sectional view illustrating operation of a compression mechanism according to a third embodiment of the present invention.

In the first embodiment, an example in which the first bulge 62 that generates the wedge effect bulges radially outward on the first sliding surface 61 of the bush 60 has been described, but the present invention is not limited to such aspect. For example, as in a compression mechanism 30A according to the third embodiment illustrated in FIG. 12, the first bulge 62 may be formed on the bush hole 45 side of the cylinder 40.

In the compression mechanism 30A, the first bulge 62 is formed so as to bulge on the bush 60 side on the inner surface 45*a* of the bush hole 45. In the present embodiment, an example in which the pair of first bulges 62 are formed so as to be positioned on both circumferential end sides in plan view of the inner surface 45*a* is given. As the shape of the first bulge 62, a similar shape to the first bulge 62 according to the first embodiment can be adopted.

Even in such configuration, the gap X having a wedge shape by the first bulge 62 is formed between the first sliding surface 61 of the bush 60 and the inner surface 45*a* of the bush hole 45. Therefore, due to the bush 60 circumferentially sliding, the lubricant Y is drawn to the circumferential center side in the plan view of the first bulge 62, and the wedge effect can promote the formation of the oil film between the first sliding surface 61 and the inner surface 45*a* of the bush hole 45.

Thus, the above-described compression mechanism 30A also achieves substantially similar effects to those by the compression mechanism 30 according to the first embodiment. In the present embodiment, the first bulge 62 is provided on the bush hole 45 side that is the sliding target of the bush 60. Thus, by providing the first bulge 62 in a predetermined part, to which a load of the bush 60 is easily applied, within the bush hole 45, it is possible to effectively form an oil film in the predetermined part to which a load is easily applied.

In each of the above embodiments, an example in which the first bulge 62 that generates the wedge effect bulges radially outward on the first sliding surface 61 of the bush 60 has been described, but the present invention is not limited to such aspect. For example, as in a compression mechanism 30B according to the fourth embodiment illustrated in FIG. 13, a recess 45*b* that generates a wedge effect may be formed on the bush hole 45 side of the cylinder 40.

Figure 13:
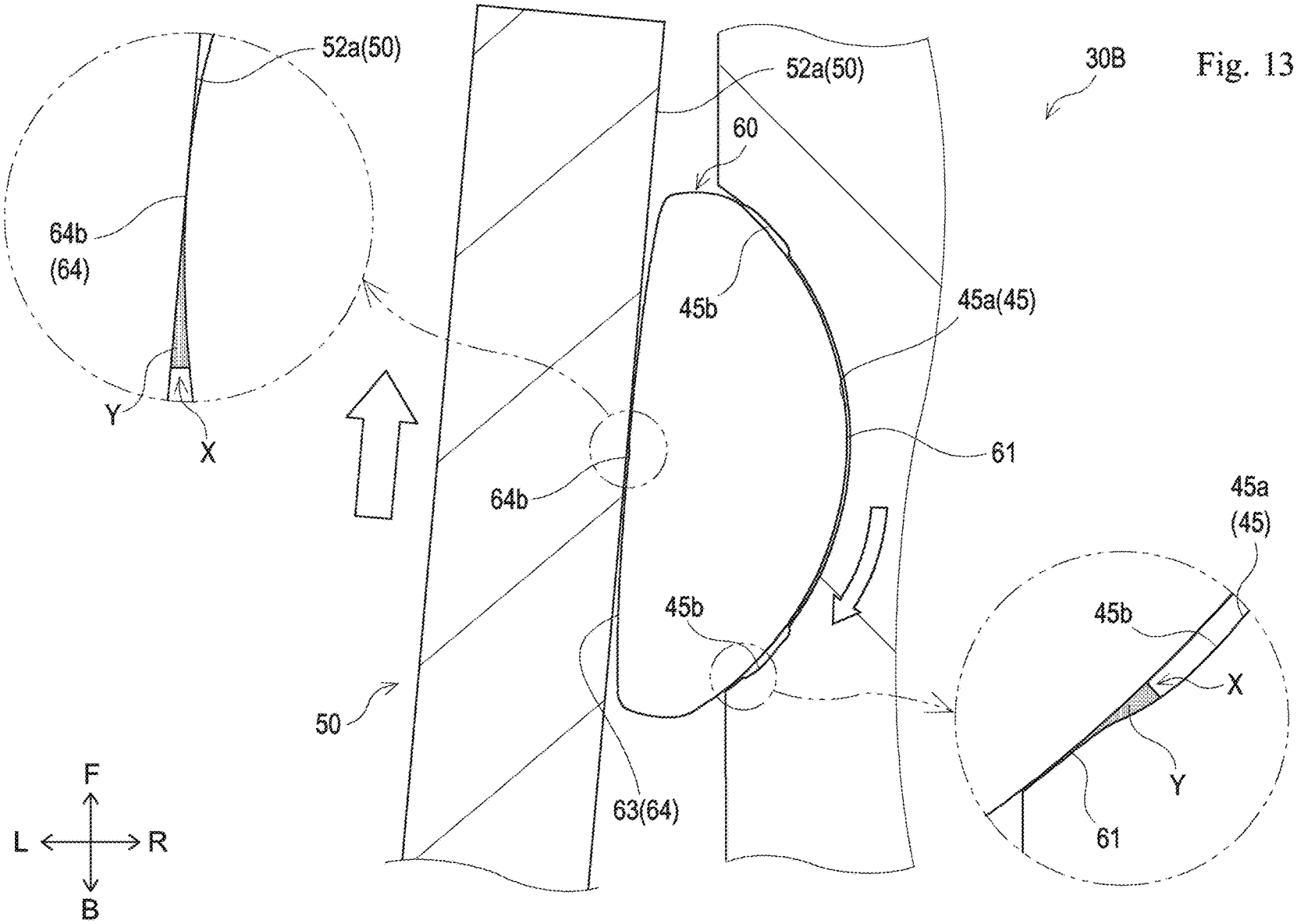
FIG. 13 is an enlarged plan cross-sectional view illustrating operation of a compression mechanism according to a fourth embodiment of the present invention.

In the compression mechanism 30B according to the fourth embodiment illustrated in FIG. 13, the recess 45*b* is formed so as to be recessed on the inner surface 45*a* of the bush hole 45. As the shape of the recess 45*b*, a shape corresponding to the first bulge 62 according to the first embodiment can be adopted.

Even in such configuration, the gap X having a wedge shape by the recess 45*b* is formed between the first sliding surface 61 of the bush 60 and the inner surface 45*a* of the bush hole 45. Therefore, when the bush 60 slides in the circumferential direction in plan view, the lubricant Y is drawn, and the wedge effect can promote the formation of the oil film between the first sliding surface 61 and the inner surface 45*a* of the bush hole 45.

Thus, the above-described compression mechanism 30B also achieves substantially similar effects to those by the compression mechanism 30 according to the first embodiment. According to the compression mechanism 30B, by performing processing of denting a part of the inner surface 45*a* of the bush hole 45 (e.g., cutting processing), it is possible to relatively easily form the recess 45*b* that generates the wedge effect.

In the present embodiment, an example in which the recess 45*b* is formed on the bush hole 45 side has been described, but in place of such an aspect, the recess 45*b* may be formed on the first sliding surface 61 of the bush 60.

As described above, the first oil film formation portion (recess 45*b*) is formed to be recessed in the inner surface 45*a*.

Such configuration can relatively easily form the first oil film formation portion (recess 45*b*). That is, by performing processing of denting a part of the inner surface 45*a* of the bush hole 45 (e.g., cutting processing), it is possible to relatively easily form the first oil film formation portion (recess 45*b*).

The recess 45*b* is an embodiment of the first oil film formation portion.

In each of the above embodiments, an example in which the pair of first oil film formation portions (the first bulge 62, the recess 45*b*) are provided so as to be positioned on both end sides in the circumferential direction in plan view of the first sliding surface 61 of the bush 60 has been described, but the present invention is not limited to such configuration. For example, the first oil film formation portion (the first bulge 62, the recess 45*b*) may be provided only on one side in the circumferential direction in plan view of the first sliding surface 61. For example, on the first sliding surface 61, the first oil film formation portion (the first bulge 62, the recess 45*b*) may be provided on the main body 51 side (rear side) of the piston 50 that is relatively far from the back pressure chamber 44 and where the oil film is easily broken. Note that in this case, an appropriate oil passage for guiding the lubricant Y from the back pressure chamber 44 of the blade groove 43 may be formed on the anti-main body 51 side (inner side) on the first sliding surface 61.

The number and positions of the first oil film formation portion (the first bulge 62, the recess 45*b*, the sliding curved surface portion 61*a*, the central curved surface portion 61*b*, the rear curved surface portion 61*c*, and the front curved surface portion 61*d*) and the second oil film formation portion (the second bulge 64) of the bush 60 are not limited to the examples described in the above embodiments. The number and positions of the first oil film formation portions (the first bulge 62, the recess 45*b*, and the like) and the second oil film formation portion (the second bulge 64) can be appropriately set from the viewpoint of effectively promoting the formation of an oil film.

In each of the above embodiments, an example in which both of the pair of bushes 60 (or the pair of bush holes 45) are provided with the first oil film formation portion (the first bulge 62, the recess 45*b*, and the like) has been described, but the present invention is not limited to such configuration. For example, one of the pair of bushes 60 (or the pair of bush holes 45) may be provided with the first oil film formation portion (the first bulge 62, the recess 45*b*, and the like).

In this case, the first oil film formation portion (the first bulge 62, the recess 45*b*, and the like) may be provided on the low-pressure-side bush 60B (or the low-pressure-side bush hole 45B) side where the sliding resistance tends to become large by the action of the load due to the pressure difference between the high-pressure chamber 41A and the low-pressure chamber 41B in the cylinder chamber 41.

Similarly to the first oil film formation portion (the first bulge 62, the recess 45*b*, and the like), the second oil film formation portion (the second bulge 64) may also be provided on one of the pair of bushes 60 (e.g., the low-pressure-side bush 60B).

In each of the above embodiments, an example in which the first oil film formation portion (the first bulge 62, the recess 45*b*, and the like) and the second oil film formation portion (the second bulge 64) are formed by cutting or the like has been described, but the present invention is not limited to such configuration. As a processing method of the first oil film formation portion (the first bulge 62, the recess 45*b*, and the like) and the second oil film formation portion (the second bulge 64), pressing, polishing, or the like can be adopted.

In each of the above embodiments, an example in which the blade groove 43 (back pressure chamber 44) is formed in a substantially rectangular shape in plan view has been described, but the present invention is not limited to such configuration. For example, the blade groove 43 (back pressure chamber 44) may be formed in a circular shape (cylindrical shape) in plan view.

The first oil film formation portions (the first bulge 62, the recess 45*b*, and the like) of the above embodiments (first to fourth embodiments) may be appropriately combined and applied to the bush 60 or the bush hole 45. For example, the first bulge 62 (see FIG. 8) of the first embodiment may be applied to the first oil film formation portion on the front side of one of the bushes 60, and the first bulge 62 (see FIG. 12) of the third embodiment may be applied to the first oil film formation portion on the rear side of the bush hole 45 sliding with the bush 60.

In each of the above embodiments, the compression mechanism 30 includes the two cylinders 40 arranged in parallel up and down, but the present invention is not limited to such configuration, and the compression mechanism may include one cylinder 40.

In each of the above embodiments, an example in which the compressor 1 is used in a household air conditioner has been described, but the present invention is not limited to such configuration. The compressor 1 can be used for, for example, an air conditioner for a vehicle (automobile), a railway, or a business.

INDUSTRIAL APPLICABILITY

The present invention can be applied to a compression mechanism.

REFERENCE SIGNS LIST

1: Compressor
30: Compression mechanism

40: Cylinder
50: Piston
60: Bush

The invention claimed is:

1. A compressor in a compression mechanism comprising:
a cylinder including a cylinder chamber and a blade groove communicating with the cylinder chamber;
a piston including a blade that partitions the cylinder chamber into a high-pressure chamber and a low-pressure chamber and is inserted into the blade groove so as to be movable forward and backward, the piston turnably provided in the cylinder chamber; and
a bush rockably accommodated in a bush hole formed in the blade groove and including a first sliding surface that slides with an inner surface of the bush hole, wherein
the compressor in the compression mechanism includes:
a first oil film formation portion formed on one of the first sliding surface and the inner surface such that a gap between the first sliding surface and the inner surface gradually decreases toward a direction in which lubricant is drawn between the first sliding surface and the inner surface along with rocking of the bush, and
the first oil film formation portion includes:
a first part formed so as to bulge on the inner surface side relative to an imaginary line constituting a curved surface in a case of assuming that the first oil film formation portion is not formed on the first sliding surface in the case where the first oil film formation portion is formed on the first sliding surface, and
a second part formed so as to bulge on the first sliding surface side relative to an imaginary line constituting a curved surface in a case of assuming that the first oil film formation portion is not formed on the inner surface in the case where the first oil film formation portion is formed on the inner surface.

2. The compressor in the compression mechanism according to claim 1, wherein the first sliding surface includes:
a first curved surface portion curved along a sliding direction, and a second curved surface portion adjacent in the sliding direction to the first curved surface, and
the first oil film formation portion includes:
the second part formed on the first sliding surface by making a radius of curvature of the second curved surface portion larger than a radius of curvature of the first curved surface.

3. The compressor in the compression mechanism according to claim 2, further comprising:
a second sliding surface that slides with a side surface of the blade, wherein
the second oil film formation portion is formed on the second sliding surface such that a gap between the second sliding surface and the side surface gradually decreases toward a direction in which lubricant is drawn between the second sliding surface and the side surface along with forward and backward movement of the blade.

4. The compressor in the compression mechanism according to claim 3, wherein
the second oil film formation portion is formed so as to bulge on the side surface side on the second sliding surface.

5. The compressor in the compression mechanism according to claim 2, wherein
a pair of the first oil film formation portions are formed so as to be positioned on both end sides in a sliding direction of the first sliding surface.

6. The compressor in the compression mechanism according to claim 1, wherein the first oil film formation portion includes
a third part formed so as to recess on the inner surface.

7. The compressor in the compression mechanism according to claim 6, further comprising:
a second sliding surface that slides with a side surface of the blade, wherein
the second oil film formation portion is formed on the second sliding surface such that a gap between the second sliding surface and the side surface gradually decreases toward a direction in which lubricant is drawn between the second sliding surface and the side surface along with forward and backward movement of the blade.

8. The compressor in the compression mechanism according to claim 7, wherein the second oil film formation portion is formed so as to bulge on the side surface side on the second sliding surface.

9. The compressor in the compression mechanism according to claim 6, wherein a pair of the first oil film formation portions are formed so as to be positioned on both end sides in a sliding direction of the first sliding surface.

10. The compression mechanism according to claim 1 further comprising:
a second sliding surface that slides with a side surface of the blade, wherein
the second oil film formation portion is formed on the second sliding surface such that a gap between the second sliding surface and the side surface gradually decreases toward a direction in which lubricant is drawn between the second sliding surface and the side surface along with forward and backward movement of the blade.

11. The compressor in the compression mechanism according to claim 10, wherein
the second oil film formation portion is formed so as to bulge on the side surface side on the second sliding surface.

12. The compressor in the compression mechanism according to claim 11, wherein
a pair of the first oil film formation portions are formed so as to be positioned on both end sides in a sliding direction of the first sliding surface.

13. The compressor in the compression mechanism according to claim 10, wherein
a pair of the first oil film formation portions are formed so as to be positioned on both end sides in a sliding direction of the first sliding surface.

14. The compressor in the compression mechanism according to claim 1, wherein
a pair of the first oil film formation portions are formed so as to be positioned on both end sides in a sliding direction of the first sliding surface.

* * * * *